US009476215B2

(12) United States Patent
Baldoni et al.

(10) Patent No.: US 9,476,215 B2
(45) Date of Patent: Oct. 25, 2016

(54) MOLDING SYSTEM FOR SWIMMING POOL COPINGS

(71) Applicant: Concrete Countertop Solutions, Inc., Clarks Summit, PA (US)

(72) Inventors: Edwin Joseph Baldoni, Union Dale, PA (US); Dario Joseph Baldoni, Boston, MA (US)

(73) Assignee: CONCRETE COUNTERTOP SOULTIONS, INC., Clarks Summit, PA (US)

( * ) Notice: Subject to any disclaimer, the term of this patent is extended or adjusted under 35 U.S.C. 154(b) by 0 days.

(21) Appl. No.: 14/787,784

(22) PCT Filed: Nov. 13, 2014

(86) PCT No.: PCT/US2014/065376

§ 371 (c)(1),
(2) Date: Oct. 29, 2015

(87) PCT Pub. No.: WO2015/084558

PCT Pub. Date: Jun. 11, 2015

(65) Prior Publication Data

US 2016/0115701 A1 Apr. 28, 2016

Related U.S. Application Data

(60) Provisional application No. 61/910,478, filed on Dec. 2, 2013, provisional application No. 61/952,630, filed on Mar. 13, 2014.

(51) Int. Cl.
*E04H 4/14* (2006.01)

(52) U.S. Cl.
CPC ..... *E04H 4/141* (2013.01)

(58) Field of Classification Search
CPC . E04H 4/142; E04H 4/141; E04H 2004/147; Y10S 249/03; E04F 2013/061; E06B 1/006; E04B 2002/7481
See application file for complete search history.

(56) References Cited

U.S. PATENT DOCUMENTS

| | | | |
|---|---|---|---|
| 3,348,801 | A | 10/1967 | Deason |
| 3,708,930 | A | 1/1973 | Stegmeier |
| 3,850,403 | A | 11/1974 | Stegmeier |
| 3,872,195 | A | 3/1975 | Stegmeier |
| 4,004,386 | A | 1/1977 | Diffenderfer |

(Continued)

OTHER PUBLICATIONS

International Search Report and Written Opinion of the International Searching Authority for International Application No. PCT/US2014/065376, mailed Sep. 2, 2015.

*Primary Examiner* — Rodney Mintz
*Assistant Examiner* — Daniel Kenny
(74) *Attorney, Agent, or Firm* — Morgan, Lewis & Bockius LLP

(57) ABSTRACT

A molding system for a swimming pool coping having a track for receiving a pool liner, the molding system including a molding platform having a flexible panel with a first side and a second side opposite the first side, at least one lip extending from the first side of the flexible panel configured to be received in the track of the swimming pool coping, a plurality of mold supports extending from the second side of the flexible panel and arranged in a row proximate a top of the flexible panel, each mold support having a top surface for supporting a mold block and a flange positioned at a first end of the mold support extending substantially perpendicularly from the top surface.

24 Claims, 10 Drawing Sheets

(56) References Cited

U.S. PATENT DOCUMENTS

| | | | | |
|---|---|---|---|---|
| 4,206,536 | A * | 6/1980 | Hammond | B60J 10/70 29/402.11 |
| 4,457,119 | A | 7/1984 | Dahowski | |
| 4,574,017 | A | 3/1986 | Stegmeier | |
| 4,735,395 | A | 4/1988 | Dahowski | |
| 4,967,424 | A | 11/1990 | Stegmeier | |
| 5,680,730 | A * | 10/1997 | Epple | E04H 4/14 362/145 |
| 6,260,313 | B1 | 7/2001 | Stegmeier | |
| 6,662,383 | B2 | 12/2003 | Cornelius et al. | |
| 6,758,025 | B2 | 7/2004 | Haberler | |
| 7,546,713 | B2 | 6/2009 | Bradley | |
| 7,861,471 | B2 | 1/2011 | Smith | |
| 8,511,014 | B2 * | 8/2013 | Delforte | E04B 2/00 52/235 |
| D689,208 | S * | 9/2013 | Crocker | D25/125 |
| 8,960,636 | B1 | 2/2015 | Stegmeier, Jr. | |
| 2004/0074159 | A1 | 4/2004 | Irgang et al. | |
| 2004/0123380 | A1 | 7/2004 | Shebek | |
| 2004/0157007 | A1 | 8/2004 | Larocque | |
| 2005/0001139 | A1 | 1/2005 | Musser | |
| 2006/0207008 | A1 | 9/2006 | Stancill | |

* cited by examiner

MOLDING SYSTEM FOR SWIMMING POOL COPINGS

CROSS-REFERENCE TO RELATED APPLICATIONS

This application is a U.S. National Stage of International Application No. PCT/US14/65376, filed Nov. 13, 2014, which claims the benefit of U.S. Provisional Patent Application No. 61/910,478, filed Dec. 2, 2013, and U.S. Provisional Patent Application No. 61/952,630, filed Mar. 13, 2014, all of which are incorporated herein by reference in their entireties.

FIELD OF THE INVENTION

The present invention, according to some embodiments, relates to a molding system for swimming pool copings. In some embodiments, the present invention relates to a molding system for molding a top of a swimming pool coping. In some embodiments, the present invention provides a molding system for a swimming pool coping particularly having a track for receiving a pool liner. In other embodiments, the present invention provides a receiver track for a swimming pool for receiving a molding system.

SUMMARY OF THE INVENTION

In some embodiments, the present invention includes a molding system for swimming pool copings. In some embodiments, the present invention includes a molding system for swimming pool copings having a track for receiving a pool liner. In some embodiments, a molding system for a swimming pool coping having a track for receiving a pool liner includes a molding platform comprising a flexible panel having a first side and a second side opposite the first side, at least one lip extending from the first side of the flexible panel configured to be received in the track of the swimming pool coping when the molding platform is engaged with the swimming pool coping, and a plurality of mold supports extending from the second side of the flexible panel and arranged in a row proximate a top of the flexible panel. In some embodiments, each mold support includes a top surface for supporting a mold block, and a flange positioned proximate an end of the mold support extending substantially perpendicularly from the top surface. In some embodiments, each mold support tapers in width from the second side of the flexible panel towards the end of the mold support. In some embodiments, the top surface of each mold support is substantially trapezoidal in shape. In some embodiments, the molding platform comprises a gap between each pair of adjacent mold supports. In some embodiments, the molding system may further include a molding block positionable on the top surface of at least one of the plurality of mold supports, the molding block having a mold surface configured to mold a predetermined contour into a material.

In some embodiments, a molding system of the present invention further includes a back panel having a front surface and a back surface, the back panel configured to engage with the molding platform and comprising at least one clip defining a slot for receiving the flange of at least one of the plurality of mold supports when the back panel is engaged with the molding platform. In some embodiments, the at least one clip is positioned on the back surface of the back panel. In further embodiments, the back panel comprises at least one clip for each mold support in the plurality of mold supports.

In further embodiments, the molding system may also include a plurality of coping tabs extending from the first side of the flexible panel and arranged in a row proximate a top of the flexible panel. In some embodiments, the plurality of coping tabs and the at least one lip define a slot for receiving a section of the swimming pool coping when the molding platform is engaged with the swimming pool coping. In some embodiments, the slot defined by the plurality of coping tabs and the at least one lip tapers from the flexible panel toward an end of the at least one lip. In some embodiments, the plurality of coping tabs extends obliquely from the first side of the flexible panel. In some embodiments, each of the plurality of coping tabs comprises a pair of side edges, a top surface extending between the pair of side edges, and a front end. In some embodiments, the top surface of each coping tab is contiguous with the top surface of at least one of the plurality of mold supports. In some embodiments, each coping tab tapers in width from the first side of the flexible panel towards the front end of the coping tab. In some embodiments, the molding platform comprises a gap between each pair of adjacent coping tabs. In some embodiments, the gap between each pair of adjacent coping tabs comprises an acute angle defined by side edges of the pair of adjacent coping tabs.

In other embodiments, the present invention includes a receiver track for engaging with a molding system for a swimming pool coping. In some embodiments, the present invention includes a swimming pool having a coping comprising a receiver track for engaging with a molding system. A receiver track according to some embodiments includes a support having a first side and a second side opposite the first side, a lower tab extending from the second side of the support, the lower tab comprising a top surface and a bottom surface, an upper tab extending from the second side of the support and positioned above the lower tab, the upper tab comprising a top surface and a bottom surface, a space defined by the top surface of the lower tab and the bottom surface of the upper tab, the space being sized and configured for receiving a portion of the molding system, and a track flange extending from the first side of the support, the track flange comprising a top surface and a bottom surface. In some embodiments, the top surface of the lower tab is substantially perpendicular to the second side of the support, and the bottom surface of the upper tab is oblique to the second side of the support. In some embodiments, the top surface of the lower tab and the bottom surface of the upper tab define an angle of about 5°. In some embodiments, the top surface of the track flange is coplanar with the top surface of the lower tab, and wherein the bottom surface of the track flange is coplanar with the bottom surface of the lower tab. In some embodiments, the top surfaces and/or the bottom surfaces of the lower tab, upper tab, and track flange are substantially trapezoidal in shape. In some embodiments, the lower tab is positioned at or proximate a bottom of the support and the upper tab is positioned at or proximate a top of the support. In some embodiments, the space defined by the top surface of the lower tab and the bottom surface of the upper tab extends across an entire width of the receiver track.

In further embodiments, a receiver track includes a support having a first side and a second side opposite the first side, a plurality of lower tabs arranged in a row and extending from the second side of the support proximate a bottom of the support, a plurality of upper tabs arranged in a row and extending from the second side of the support proximate a top of the support, and a plurality of track flanges arranged in a row and extend from the first side of the support proximate the bottom of the support. In some embodiments, the plurality of lower tabs and the plurality of upper tabs are configured to clip onto a portion of a molding system. In some embodiments, the receiver track comprises an equal number of lower tabs, upper tabs, and track flanges. In some embodiments, each of the lower tabs, the upper tabs, and the track flanges has a substantially trapezoidal shape. In some embodiments, the receiver track further comprises gaps between adjacent lower tabs, adjacent upper tabs, and adjacent track flanges. The gaps may comprise an acute angle from about 0° to about 28° according to some embodiments. In some embodiments, the gaps between adjacent upper tabs are aligned with and vertically spaced from the gaps between adjacent lower tabs.

The present invention, according to yet further embodiments, includes a kit for molding a swimming pool coping. In some embodiments, the kit includes a molding system having a molding platform comprising a flexible panel having a first side and a second side opposite the first side, at least one lip extending from the first side of the flexible panel, a plurality of mold supports extending from the second side of the flexible panel and arranged in a row proximate a top of the flexible panel, each mold support comprising a top surface for supporting a mold block and a flange positioned proximate an end of the mold support extending substantially perpendicularly from the top surface. In some embodiments, the kit further includes a receiver track configured to engage with the molding system comprising a support having a first side and a second side opposite the first side, a lower tab extending from the second side of the support, the lower tab comprising a top surface and a bottom surface, an upper tab extending from the second side of the support and positioned above the lower tab, the upper tab comprising a top surface and a bottom surface, and a space defined by the top surface of the lower tab and the bottom surface of the upper tab, the space being sized and configured for receiving the at least one lip of the molding system when the receiver track is engaged with the molding system. In some embodiments, the molding platform further comprises a plurality of coping tabs extending from the first side of the flexible panel and arranged in a row proximate a top of the flexible panel, the plurality of coping tabs and the at least one lip defining a slot for receiving the upper tab of the receiver track when the receiver track is engaged with the molding system. In some embodiments, the kit further includes a back panel having a front surface and a back surface, the back panel configured to engage with the molding platform and comprising at least one clip defining a slot for receiving the flange of at least one of the plurality of mold supports when the back panel is engaged with the molding platform. In some embodiments, the kit further includes a molding block positionable on the top surface of at least one of the plurality of mold supports, the molding block having a contoured mold surface.

BRIEF DESCRIPTION OF THE DRAWINGS

The following detailed description of the invention will be better understood when read in conjunction with the appended drawings. For the purpose of illustrating the invention, there are shown in the drawings embodiments which are presently preferred. It should be understood, however, that the invention can be embodied in different forms and thus should not be construed as being limited to the embodiments set forth herein.

DETAILED DESCRIPTION

Figure 1:
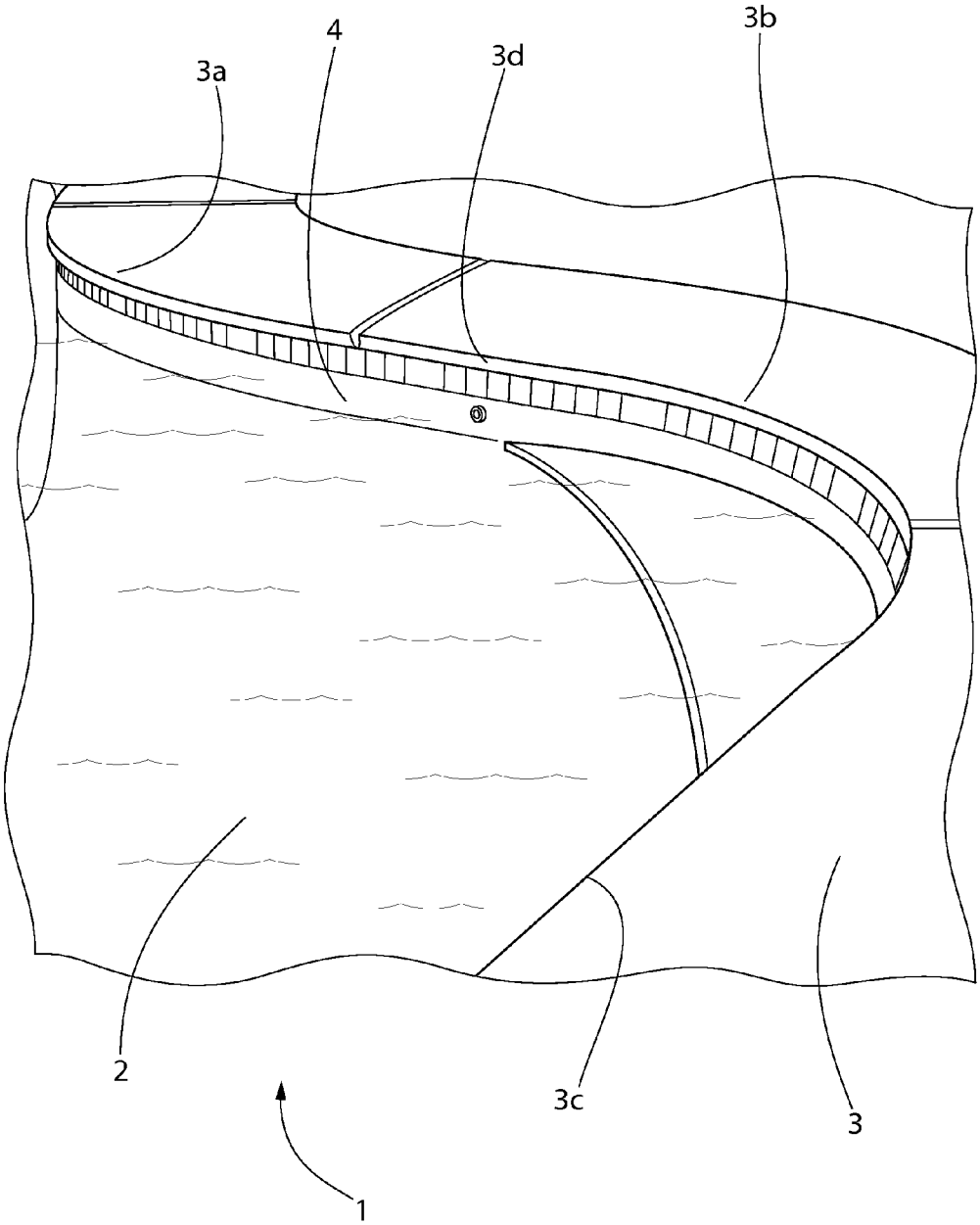
FIG. 1 illustrates an exemplary swimming pool in accordance with an embodiment of the present invention.

The present invention will now be described more fully hereinafter with reference to the accompanying Figures in which representative embodiments are shown and wherein like reference numerals indicate like elements throughout. The present invention can, however, be embodied in different forms and should not be construed as limited to the embodiments set forth herein. Rather, these embodiments are provided to describe and enable one of skill in the art. All publications, patent applications, patents, and other references mentioned herein are incorporated by reference in their entirety.

FIG. 1 illustrates a swimming pool 1 in accordance with an embodiment of the present invention which includes an interior space 2 configured to be filled with water. Swimming pool 1 further includes a coping around the periphery of interior space having a top 3 that surrounds the perimeter of interior space 2 and caps the walls of the swimming pool which define interior space 2. Top 3 may, for example, include curved sections 3*a* and 3*b* and/or substantially straight sections 3*c* in accordance with the desired shape of interior space 2. Top 3 further includes an edge 3*d* which may extend over and/or into interior space 2.

Figure 2:
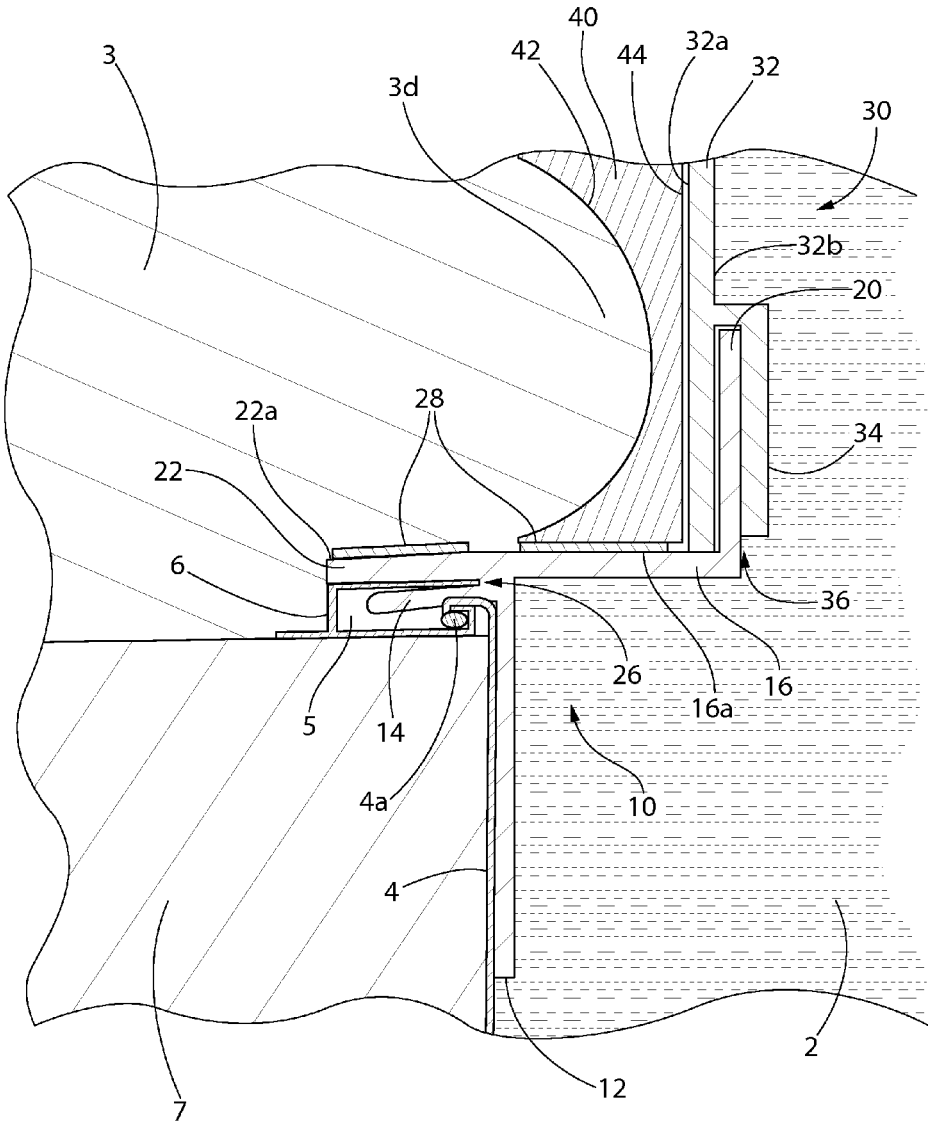
FIG. 2 is a side cross sectional view of a molding system engaged with a swimming pool coping in accordance with an embodiment of the present invention.

In some embodiments, swimming pool 1 further includes a pool liner 4 that is configured to line the walls of swimming pool 1. Pool liner 4 may be configured as a waterproof, flexible sheet and, in some embodiments, may be made from a plastic material (e.g., vinyl). Referring now to FIG. 2, which shows a cross-sectional view of an exemplary swimming pool coping in conjunction with a molding system in accordance with an embodiment of the present invention, the swimming pool coping includes a track 6 defining space 5 configured to receive a top section of pool liner 4. In some embodiments, pool liner 4 includes a bead 4*a* or other element configured to secure pool liner 4 with track 6. Track 6 may extend substantially along the entire periphery of interior space 2 and may be positioned on wall portion 7 of the swimming pool. Top 3 of the swimming pool coping, according to certain embodiments, may be formed from concrete or other similar material which is poured over track 6 and wall portion 7, molded into its final desired shape, and allowed to set.

Referring now to FIGS. 2-7, there is shown a molding system for a swimming pool coping in accordance with exemplary embodiments of the present invention. The molding system according to certain embodiments of the present invention is particularly useful for molding the top of a swimming pool coping, for example, top 3 described above. In certain preferred embodiments of the present invention, the molding system includes a molding platform 10 that is configured to engage with the swimming pool coping. In some embodiments, the molding system further includes a backing 30 that is configured to engage with molding platform 10. In further embodiments, the molding system includes a molding block 40 positionable on molding platform 10 as will be described herein.

As shown particularly in FIGS. 2-6, molding platform 10 in some embodiments may include a panel 12 having a first side 12*a* and a second side 12*b* opposite first side 12*a*. First side 12*a* and second side 12*b* may be substantially rectangular in shape or may be configured as another polygonal shape. In other embodiments, panel 12 may include one or more curved edges. In some embodiments, panel 12 is a flexible panel such that first side 12*a* and second side 12*b* can be curved convexly and/or concavely, and is preferably configured to substantially conform to a curvature of a swimming pool wall. When molding platform 10 is in an unflexed or relaxed state, according to some embodiments, each of first side 12*a* and second side 12*b* is substantially planar.

Figure 3:
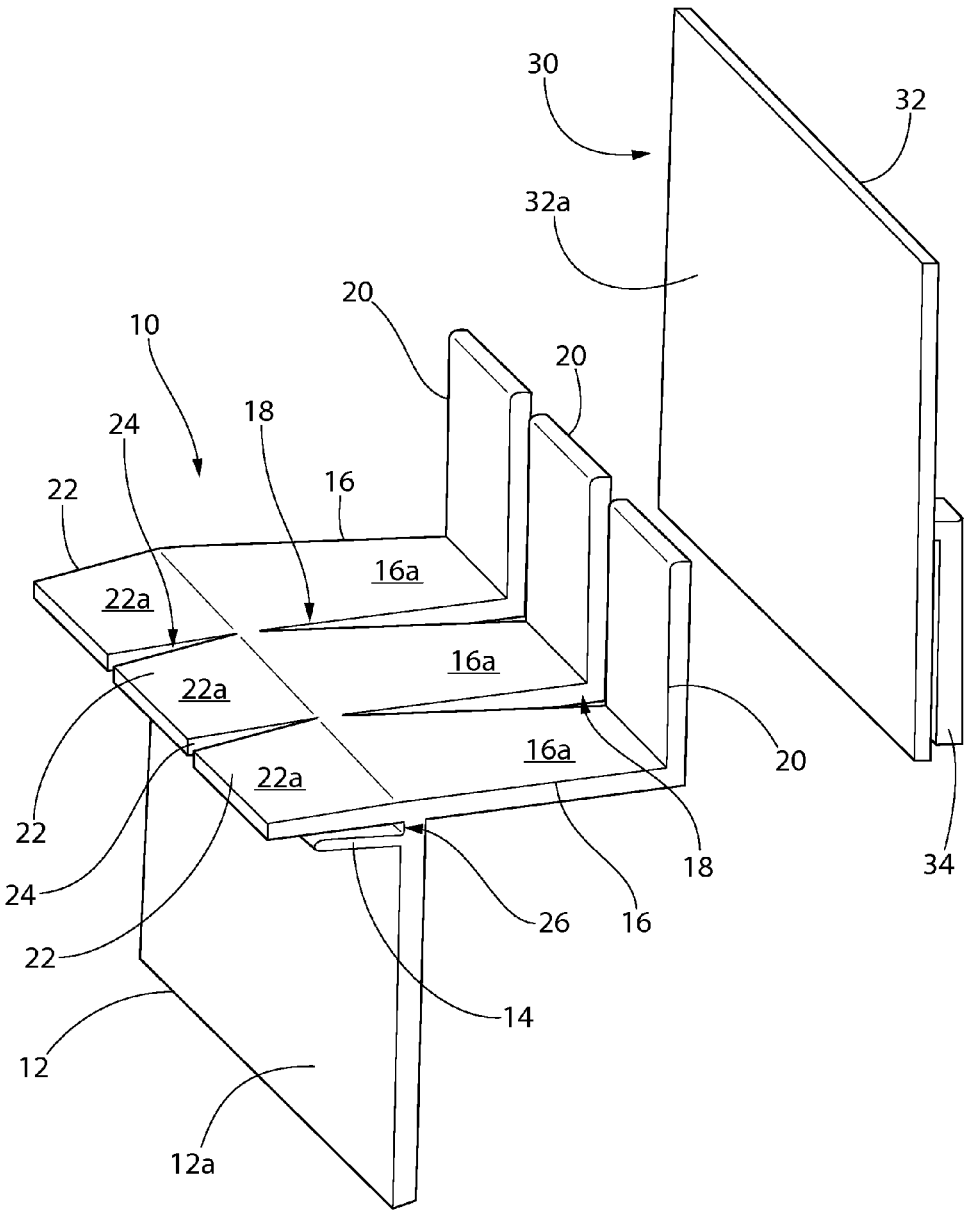
FIG. 3 is an exploded front perspective view of a molding platform and backing in accordance with an embodiment of the present invention.
Figure 4:
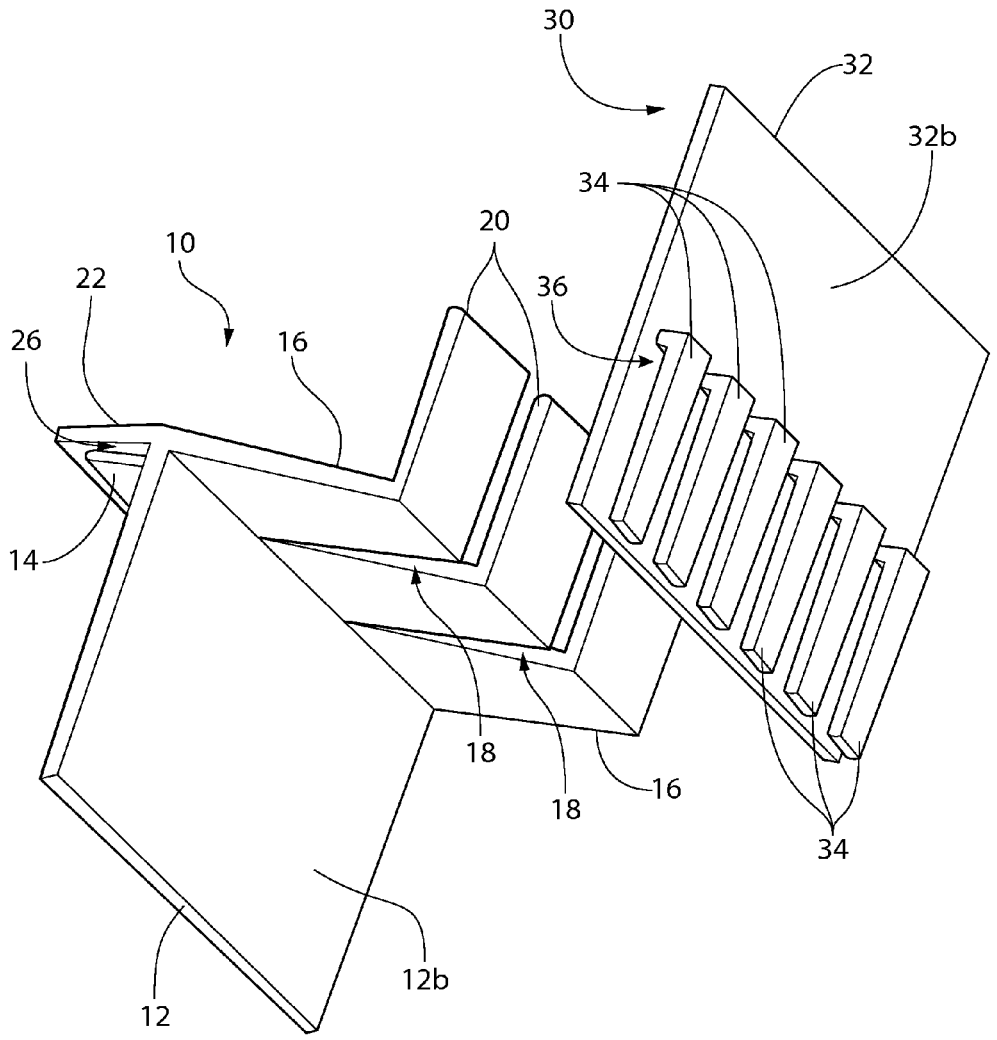
FIG. 4 is an exploded rear perspective view of the molding platform and backing of FIG. 3.
Figure 6:
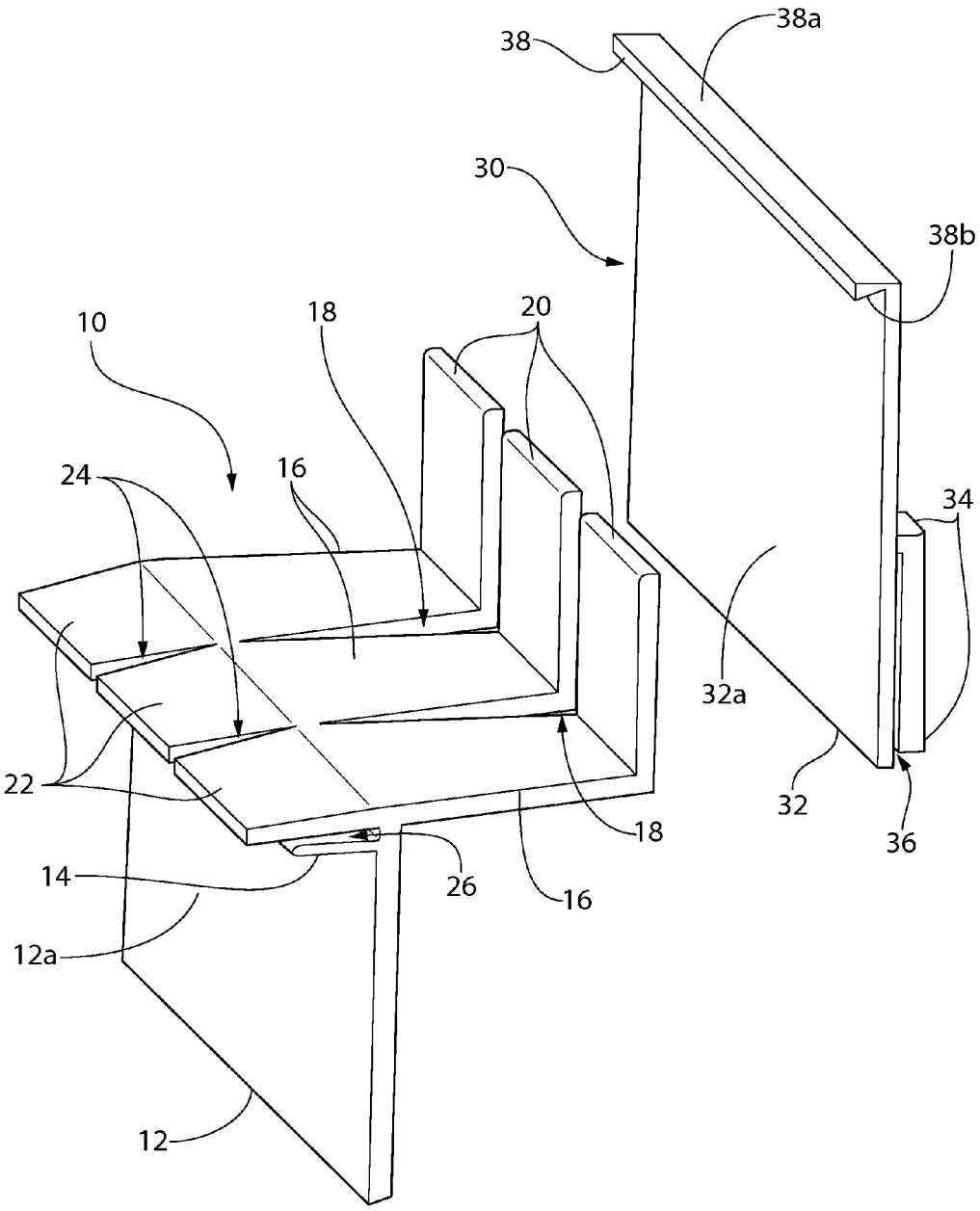
FIG. 6 is an exploded front perspective view of a molding platform and backing in accordance with another embodiment of the present invention.

In some embodiments of the present invention, molding platform 10 includes one or more mold supports 16. Molding platform 10, in certain preferred embodiments, includes a plurality of mold supports 16 that are configured to support one or more molding blocks 40 (see, e.g., FIG. 2). Mold supports 16 may be formed integrally with panel 12, or formed separately from panel 12 and secured thereto using any suitable means known in the art (e.g., adhesive, fasteners, joinery techniques, welding, etc.). In some embodiments, mold supports 16 are arranged in a row proximate a top of panel 12, for example, as shown in FIGS. 3, 4, 6, and 7. In some embodiments, mold supports 16 extend from second side 12*b* of panel 12 and may be substantially perpendicular to panel 12. Top surfaces 16*a* of the plurality of mold supports 16 are substantially coplanar according to some embodiments, and are configured to support one or more molding blocks 40. In some embodiments, top surfaces 16*a* are continguous with the top edge of panel 12. In some embodiments, top surfaces 16*a* are substantially perpendicular to second side 12*b* of panel 12. In some embodiments, each mold support 16 is configured as a cantilever having a length L1 extending from second side 12*b* of panel 12. For ease of illustration FIGS. 3, 4, and 6 show only three mold supports 16, however, it should be appreciated that molding platform 10 may include any suitable number of mold supports 16. In some embodiments, molding platform 10 includes at least two mold supports 16, at least three mold supports 16, at least four mold supports 16, at least five mold supports 16, at least six mold supports 16, at least seven mold supports 16, at least eight mold supports 16, at least nine mold supports 16, at least ten mold supports 16, at least eleven mold supports 16, or at least twelve mold supports 16. In certain preferred embodiments, mold supports 16 are spaced evenly along the top of panel 12. In some embodiments, each of the plurality of mold supports 16 is configured substantially the same.

Referring again to FIGS. 3, 4, 6, and 7, in some embodiments, adjacent mold supports 16 are separated by a gap 18. In some embodiments, each gap 18 has a length equal to the length of each mold support 16 (e.g., L1 in FIG. 7). In other embodiments, gap 18 has a length shorter than the length of each mold support 16 (e.g., less than L1). Gaps 18 in some embodiments are configured to provide a degree of clearance between adjacent mold supports 16 to allow for molding platform 10 to be curved, for example, in directions C1 and C2 depicted in FIG. 7. This may be advantageous according to certain embodiments, for example, when molding platform 10 is engaged with a swimming pool coping along a curved section of the swimming pool (e.g., sections 3*a* and 3*b* of FIG. 1).

Figure 7:
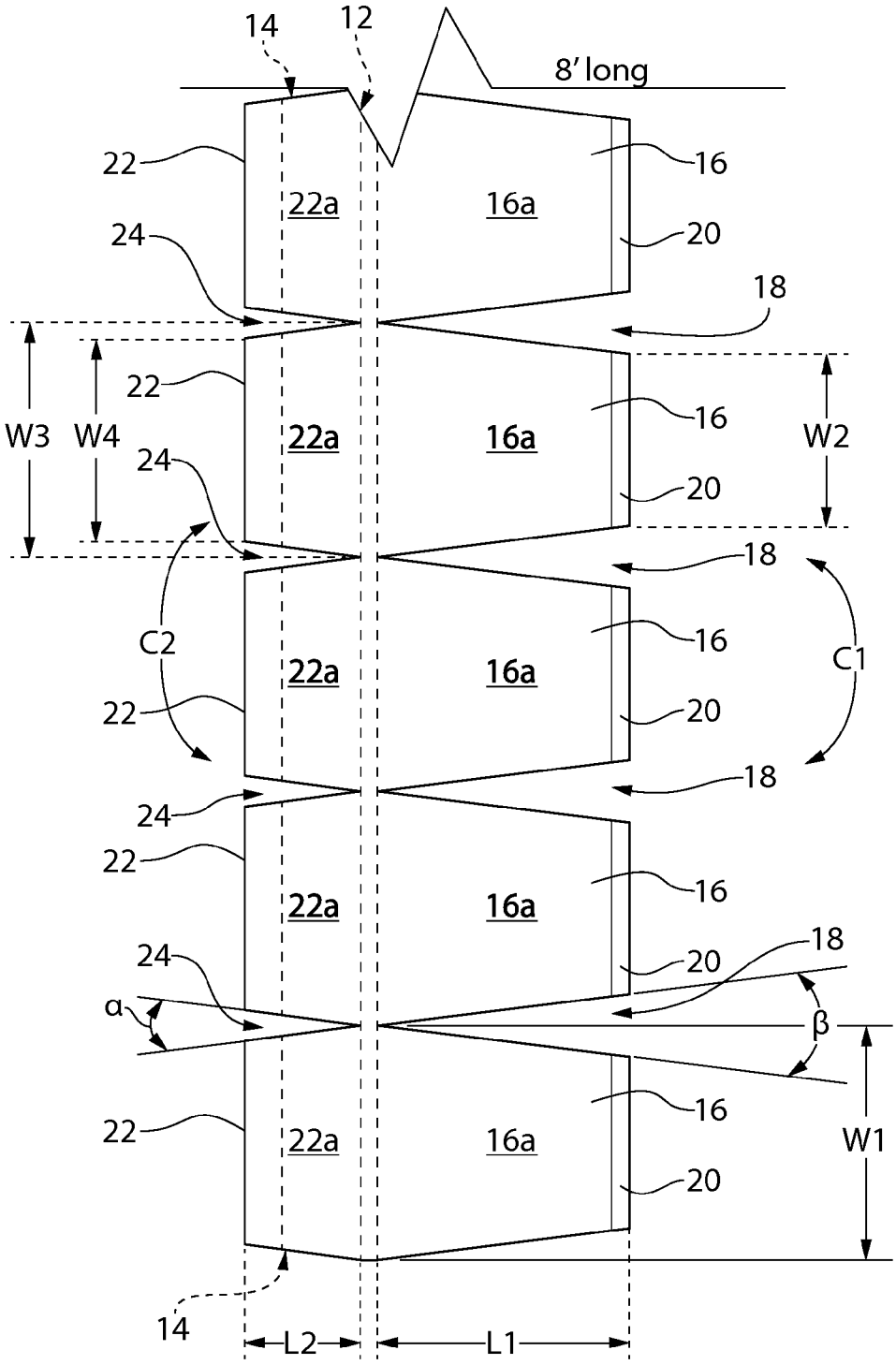
FIG. 7 is a top plan view of a molding platform in accordance with another embodiment of the present invention.

As further shown in FIG. 7, top surface 16*a* of each mold support 16 in some embodiments may be substantially trapezoidal in shape. According to some of these embodiments, top surface 16*a* has a width that tapers from W1 to W2 as mold support 16 extends away from panel 12, where W1 is greater than W2. In certain preferred embodiments, each top surface 16*a* of the mold supports 16 is substantially configured as an isosceles trapezoid having parallel sides (bases) with dimensions W1 and W2, and a perpendicular distance between the parallel sides (altitude) having a dimension equal to L1. Mold supports 16 according to these embodiments may further include a pair of side edges that extend between and are obliquely angled relative to the parallel sides and which have equal lengths greater than L1. Gap 18 may be defined by angle β formed between adjacent mold supports 16 in the plane of top surfaces 16*a* according to these embodiments. In some embodiments, angle β is equal to the angle between the neighboring side edges of adjacent mold supports 16. In some embodiments, angle β is an acute angle from about 1° to about 45°, about 1° to about 40°, about 1° to about 35°, about 1° to about 30°, about 1° to about 25°, about 1° to about 20°, about 1° to about 15°, about 1° to about 10°, or about 1° to about 5°. In some embodiments, when molding platform 10 is an unflexed or relaxed state, angle β is from about 5° and about 25°, about 10° and about 20°, about 12° and about 18°, or about 14° and about 16°. In one embodiment, angle β is about 14°.

In some embodiments, one or more of mold supports 16 of molding platform 10 may further include a flange 20. In some embodiments, fewer than all the mold supports 16 include a flange 20. In some embodiments, each mold support 16 includes a flange 20. Flange 20 in some embodiments is positioned proximate an end of mold support 16 (e.g., an end of mold support 16 furthest away from panel 12) and may extend substantially perpendicular from top surface 16*a*. In some embodiments, each flange 20 has a width substantially equal to W2. In other embodiments, flange 20 has a width less than W2. In some embodiments, flanges 20 are configured to engage with backing 30 as will be described further herein.

Molding platform 10 in some embodiments of the present invention may include one or more coping tabs 22. In some preferred embodiments, molding platform 10 includes a plurality of coping tabs 22. In some embodiments, the number of coping tabs 22 is less than the number of mold supports 16. In other embodiments, the number of coping tabs 22 is greater than the number of mold supports 16. In some preferred embodiments, the number of coping tabs 22 is equal to the number of mold supports 16. In some embodiments, coping tabs 22 are arranged in a row proximate a top of panel 12, for example, as shown in FIGS. 3, 4, 6, and 7. In some embodiments, coping tabs 22 extend from first side 12*a* of panel 12. In some embodiments, each coping tab 22 is configured as a cantilever having a length L2 extending from first side 12*a* of panel 12. In some embodiments, coping tabs 22 extend from first side 12*a* of panel 12 opposite of mold supports 16. In some embodiments, the plurality of coping tabs 22 are substantially aligned with the plurality of mold supports 16 along the top of panel 12, as shown for example in FIGS. 3, 6, and 7. In certain preferred embodiments, coping tabs 22 are spaced evenly along the top of panel 12. In some embodiments, each of the plurality of coping tabs 22 is configured substantially the same. Coping tabs 22 may be formed integrally with panel 12 and/or mold supports 16, or may be formed separated from panel 12 and/or mold supports 16 and secured thereto using any suitable means known in the art (e.g., adhesive, fasteners, joinery techniques, welding, etc.).

Figure 5:
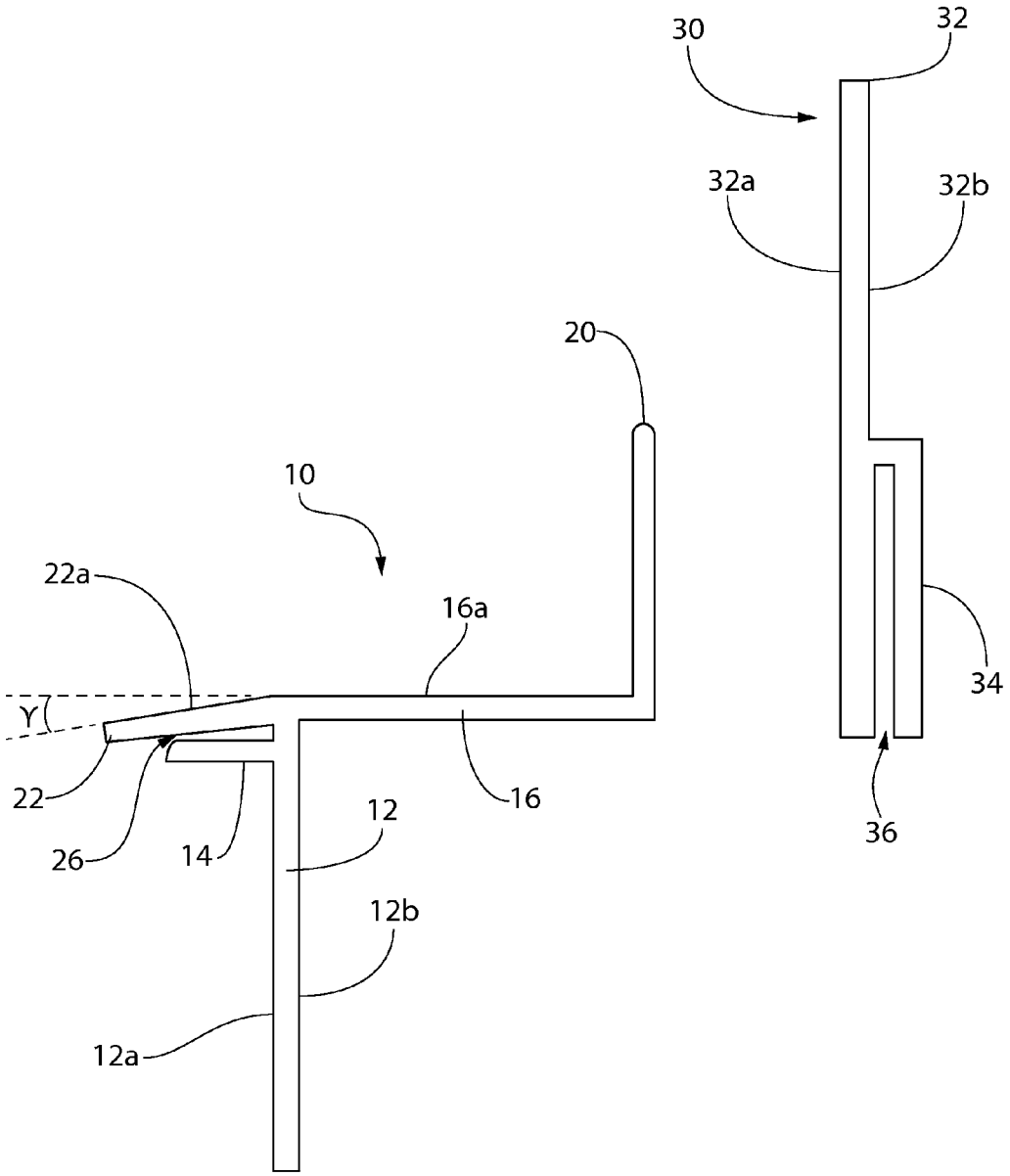
FIG. 5 is an exploded side view of the molding platform and backing of FIGS. 3 and 4.

Top surfaces 22*a* of coping tabs 22 are substantially coplanar according to some embodiments. In some embodiments, top surfaces 22*a* of coping tabs 22 are continguous with top surfaces 16*a* of mold supports 16. In some embodiments, top surfaces 22*a* of coping tabs 22 are continguous with top surfaces 16*a* of mold supports 16 and the top edge of panel 12. In some embodiments, top surfaces 22*a* are substantially perpendicular to first side 12*a* of panel 12. In some embodiments, top surfaces 22*a* are substantially coplanar with top surfaces 16*a*. In other embodiments, top surfaces 22*a* are obliquely angled relative to first side 12*a* of panel 12. In some embodiments, top surfaces 22*a* are obliquely angled relative to first side 12*a* of panel 12 prior to engagement of molding platform 10 with the pool liner track. In some embodiments, top surface 22*a* extends at an incline relative to top surface 16*a*. As shown in FIG. 5, in some embodiments top surface 22*a* of coping tab 22 lies in a first plane and top surface 16*a* of molding support 16 lies in a second plane, wherein angle $\gamma$ between the first plane and the second plane is greater than 0° and less than 90°. In some embodiments, angle $\gamma$ is about 1° to about 10°, about 2° to about 9°, about 3° to about 7°, about 4° to about 6°, or about 5°.

Referring again to FIGS. 3, 6, and 7, in some embodiments, adjacent coping tabs 22 are separated by a gap 24. In some embodiments, each gap 24 has a length equal to the length of each coping tab 22 (e.g., L2 in FIG. 7). In other embodiments, gap 24 has a length shorter than the length of each coping tab (e.g., less than L2). Gaps 24 in some embodiments are configured to provide a degree of clearance between adjacent coping tabs 22 to allow for molding platform 10 to be curved, for example, in directions C1 and C2 depicted in FIG. 7. This again may be advantageous according to certain embodiments, for example, when molding platform 10 is engaged with a swimming pool coping along a curved section of the swimming pool (e.g., curved sections 3*a* and 3*b* of FIG. 1). In some embodiments, gaps 24 are substantially aligned with gaps 18, for example, as can be seen in FIG. 7.

As further shown in FIG. 7, top surface 22*a* of each coping tab 22 in some embodiments may be substantially trapezoidal in shape. According to some of these embodiments, top surface 22*a* has a width that tapers from W3 to W4 as coping tab 22 extends away from panel 12, where W3 is greater than W4. In certain preferred embodiments, each top surface 22*a* of the coping tabs 22 is substantially configured as an isosceles trapezoid having parallel sides (bases) with dimensions W3 and W4, and a perpendicular distance between the parallel sides (altitude) having a dimension equal to L2. Coping tabs 22 according to these embodiments may further include a pair of side edges that extend between and are obliquely angled relative to the parallel sides and which have equal lengths greater than L2. In some embodiments, L2 is less than L1. In some embodiments, W3 is equal to W1. In further embodiments, W4 is greater than W2. Thus, in certain embodiments, W2<W4<W3=W1.

Gap 24 may be defined by angle $\alpha$ formed between adjacent coping tabs 22 in the plane of top surfaces 22*a* according to some of these embodiments. In some embodiments, angle $\alpha$ is equal to the angle between the neighboring side edges of adjacent coping tabs. In some embodiments, angle $\alpha$ is an acute angle from about 1° to about 45°, about 1° to about 40°, about 1° to about 35°, about 1° to about 30°, about 1° to about 25°, about 1° to about 20°, about 1° to about 15°, about 1° to about 10°, or about 1° to about 5°. In some embodiments, when molding platform 10 is an unflexed or relaxed state, angle $\alpha$ is from about 5° and about 25°, about 10° and about 20°, about 12° and about 18°, or about 14° and about 16°. In one embodiment, angle $\alpha$ is about 14°. In some embodiments, angle $\alpha$ is substantially equal to angle $\beta$ when molding platform 10 is an unflexed or relaxed state.

In certain embodiments of the present invention, molding platform 10 further includes at least one lip 14 configured to be received in space 5 defined by track 6 of the swimming pool coping (see, e.g., FIG. 2) when molding platform 10 is engaged with the swimming pool coping. In some embodiments, lip 14 extends from first side 12*a* of panel 12. In some embodiments, lip 14 is substantially perpendicular to first side 12*a* of panel 12. In some embodiments, lip 14 is configured as a cantilever extending from first side 12*a* of panel 12. In some embodiments, lip 14 has a width substantially the same as a width of panel 12. In some embodiments, lip 14 has a width less than the width of panel 12. In some embodiments, lip 14 is integrally formed with panel 12. In further embodiments, lip 14 is formed separately from panel 12 and secured thereto using any suitable means known in the art (e.g., adhesive, fasteners, joinery techniques, welding, etc.). In some embodiments, molding platform 10 includes a plurality of lips 14. In some embodiments, the plurality of lips 14 is arranged in a row on first side 12*a* of panel 12. In some of these embodiments, adjacent pairs of lips 14 are separated by gaps which, for example, may be vertically aligned with gaps 24. In some embodiments, the plurality of lips 14 is spaced evenly substantially across a width of first side 12*a*.

As shown in FIGS. 2-6, in some embodiments lips 14 are vertically aligned with and spaced below coping tabs 22. In some embodiments, molding platform 10 includes an equal number of lips 14 and coping tabs 22. In some embodiments, lips 14 have a length that is shorter than a length of coping tabs such that lips 14 do not extend beyond the ends of coping tabs 22. In some embodiments, coping tabs 22 and lips 14 cooperate to clip onto a portion of the swimming pool coping in order to releaseably secure molding platform 10 with the swimming pool coping. In some embodiments, lips 14 and coping tabs 22 define slot 26 configured to receive a portion of the swimming pool coping when molding platform 10 is engaged with the swimming pool coping. As shown in FIG. 2, for example, slot 26 located between coping tab 22 and lip 14 is configured in some embodiments to receive a portion of track 6 of the swimming pool coping. In some embodiments, molding platform 10 is configured to substantially prevent concrete or other materials from entering into space 5 of track 6 where molding platform 10 is engaged with the swimming pool coping.

As described herein, the molding system of the present invention in some embodiments further includes a backing 30. As shown in FIGS. 3-6, backing 30 in some embodiments includes a back panel 32 having a front surface 32*a* and a back surface 32*b* opposite front surface 32*a*. In some embodiments, back panel 32 is a flexible panel such that front surface 32*a* and back surface 32*b* can be curved convexly and/or concavely. When back panel 32 is in an unflexed or relaxed state, according to some embodiments, each of front surface 32*a* and back surface 32*b* is substantially planar. In some embodiments, front surface 32*a* and back surface 32*b* may be substantially rectangular in shape, or may be configured as another polygonal shape in other embodiments. In some embodiments, back panel 32 has width substantially equal to the width of panel 12.

Backing 30 is configured to engage with molding platform 10 according to some embodiments of the present invention. In some embodiments, backing 30 is configured to be releaseably secured to molding platform 10. In some embodiments, backing 30 includes one or more securements configured to engage with one or more components of molding platform 10 in order to secure backing 30 to molding platform 10. In some embodiments, backing 30 is configured to attach to flanges 20 of mold supports 16. In some embodiments, for example, backing 30 includes at least one clip 34 configured to attach back panel 32 with molding platform 10, preferably a plurality of clips 34. In some embodiments, clips 34 define a slot 36 configured to receive a flange 20 when backing 30 is engaged with molding platform 10 (see, e.g., FIG. 2). In some embodiments, backing 30 includes a plurality of clips 34 arranged in a row on back surface 32*b* of back panel 32, for example, as shown in FIG. 4. Clips 34 may be formed integrally with back panel 32 according to some embodiments, or clips 34 may be formed separately and secured to back panel 32 using any suitable means known in the art (e.g., adhesive, fasteners, joinery techniques, welding, etc.). In some embodiments, the number of clips 34 positioned on back panel 32 is at least equal to the number of flanges 20 present on molding platform 10. In some embodiments, backing 30 includes at least two clips 34 for every flange 20 present on molding platform 10. Six clips 34 and three flanges 20 are shown in the embodiment of FIG. 4 for ease of illustration, however, it should be understood that other embodiments of the inventions can have fewer or more clips 34 and/or flanges 20. In other embodiments of the present invention, backing 30 may be secured to molding platform 10 using other suitable fasteners known in the art, for example, screws, pins, staples, nails, adhesive tape (e.g., double-sided tape), hook-and-loop fasteners (e.g., Velcro®), or the like, which are capable of attaching back panel 32 to flanges 20.

With particular reference now to FIG. 6, in certain embodiments backing 30 further includes ledge 38. In some embodiments, ledge 38 extends from back panel 32 proximate a top of back panel 32. In some embodiments, ledge 38 extends from front surface 32*a* of back panel 32. In some embodiments, ledge 38 spans the entire width of back panel 32. In some embodiments, ledge 38 includes a top surface 38*a*, a bottom surface 38*b*, and a thickness therebetween. Top surface 38*a* of ledge 38 in some embodiments is substantially perpendicular to front surface 32*a* of back panel 32. In some embodiments, ledge 38 is configured such that top surface 38*a* and bottom surface 38*b* are not parallel. In some embodiments, bottom surface 38*b* is oblique relative to top surface 38*a* and/or front surface 32*a*. In some embodiments, the thickness of ledge 38 increases as ledge 38 extends away from back panel 32.

Referring again to FIG. 2, backing 30 in some embodiments is preferably configured to engage with molding platform 10 such that back surface 32*b* of back panel 32 abuts flanges 20 of mold supports 16 while front surface 32*a* of back panel 32 provides an engagement surface for molding block 40 during use of the molding system. In some embodiments, ledge 38 of backing 30 (see FIG. 6) further engages with molding block 40. In some embodiments, molding block 40 snap fits under ledge 38. In some embodiments of the present invention, molding block 40 is positioned on mold supports 16 of molding platform 10 and abuts front surface 32*a* of back panel 32 during use of the molding system. In other embodiments of the present invention, backing 30 is not utilized such that molding block 40 may directly abut against flanges 20 of mold supports 16. In some embodiments, molding block 40 is positioned directly on top surface 16*a* of mold supports 16. In some embodiments, one or more boards 28 are positioned between molding bock 40 and top surface 16*a* of mold supports 16. One or more boards 28, in some embodiments, are configured to cover gaps 18 between adjacent mold supports 16. In some embodiments, one or more boards 28 are also positioned over top surface 22*a* of coping tabs 22 to cover gaps 24 between adjacent coping tabs 22. In some embodiments, one or more boards 28 are configured to prevent concrete or other materials from passing through gaps 18 and/or gaps 24 during use of the molding system.

Molding block 40 according to certain embodiments of the invention includes a mold surface 42 configured to mold a contour into concrete or other material used to form top 3 of the swimming pool coping, e.g., a predetermined contour. Mold surface 42 may include any desired curvatures and/or patterns suitable for shaping top 3 of the swimming pool coping. As depicted in the embodiment shown in FIG. 2, mold surface 42 may include a profile having a concave curvature, which would impart a convexly curved profile to the edge 3*d* of top 3. However, it should be understood that mold surface 42 in other embodiments may include a profile having convex curvatures and/or straight portions as desired. Mold surface 42 generally faces away from flanges 20 of molding supports 16 when molding block 40 is positioned on molding platform 10 during use. Molding block 40 in some embodiments further includes a back surface 44 opposite mold surface 42. In some embodiments, back surface 44 of molding block 40 is configured to abut against front surface 32*a* of back panel 32 and/or flanges 20 of mold supports 16. Back surface 44 may include a substantially straight profile as shown in FIG. 2 according to some embodiments. In some embodiments, molding block 40 has a height that is substantially equal to the height of back panel 32. In other embodiments, molding bock 40 has a height less than the height of back panel 32. In some embodiments where backing 30 includes ledge 38, for example as shown in FIG. 6, molding block 40 is configured to seat against front surface 32*a* below ledge 38.

In use, according to some embodiments of the present invention, molding platform 10 is first engaged with the coping of a swimming pool. As described herein, in some embodiments molding platform 10 includes at least one lip 14 which is inserted into space 5 defined by track 6 of the swimming pool coping, as shown for example in FIG. 2. According to some of these embodiments, coping tab 22 is positioned over track 6 such that a portion of track 6 is received between coping tab 22 and lip 14 in slot 26. In some embodiments, coping tab 22 is configured to bend away from lip 14 when the portion of track 6 is received within slot 26 (e.g., such that angle γ depicted in FIG. 5 decreases). In some embodiments, the engagement of molding platform 10 with track 6 as described herein secures molding platform 10 to the swimming pool coping. In some embodiments, adhesive tape or other materials and/or fasteners may be used to facilitate securing of molding platform 10 to the swimming pool coping. In some embodiments, front side 12*a* of panel 12 is configured to abut pool liner 4 and/or wall portion 7 when molding platform 10 is secured to the swimming pool coping. In some embodiments, molding platform 10 is configured to curve to match the curvature of the swimming pool walls. For example, as described previously above, in some embodiments gaps 18 and/or gaps 24 are configured to allow bending of molding platform 10. In some embodiments, when molding platform 10 is properly positioned, mold supports 16 extend away from track 6 and into or over interior space 2 of the swimming pool.

After molding platform 10 is secured to the swimming pool coping, backing 30 may be engaged with molding platform 10 according to some embodiments of the present invention. In other embodiments, backing 30 is secured to molding platform 10 prior to engagement of molding platform 10 with the swimming pool coping. As described herein, backing 30 may engage with molding platform 10 using one or more clips 34 arranged on back panel 32 according to some embodiments of the present invention. For example, in some embodiments, flanges 20 of mold supports 16 are received in slot 36 defined by clips 34 such that back surface 32*b* of back panel 32 abuts flanges 20 of mold supports 16.

Molding block 40, in some embodiments, is then positioned on molding platform 10. In some embodiments, molding block 40 is positioned on top surface 16*a* of mold supports 16 such that back surface 44 of molding block 40 faces toward backing 30 and mold surface 42 faces toward the swimming pool coping. In some embodiments, molding block 40 is positioned such that back surface 44 of molding block 44 abuts front surface 32*a* of back panel 32. In some embodiments, molding block 40 and backing 30 are arranged such that back panel 32 is disposed between molding block 40 and flanges 20 of mold supports 16. In some embodiments, one or more boards, tape or other liner 28 is disposed between molding block 40 and mold supports 16. One or more boards 28 may also be positioned over coping tabs 22. Preferably the one or more boards 28 are sized and shaped to cover gaps 18 and/or gaps 24 of molding platform 10.

Concrete or other material used to form top 3 of the swimming pool coping can then be poured over wall portion 7 and track 6, the concrete or other material being at least partially bounded by molding block 40. Preferably the amount of concrete or other material used to form top 3 does not exceed the top of molding block 40 and/or backing 30. As the concrete or other material sets, it is shaped by mold surface 42 of molding block 40 to form edge 3*d*. In some embodiments, molding platform 10, backing 30, and molding block 40 are removed from the swimming pool coping before the concrete or other material completely hardens, for example, to allow the surface of the concrete or other material to be smoothed or textured. Preferably, molding platform 10, backing 30, and molding block 40 of the molding system are reusable. In some embodiments, for example, a molding system can be used to mold one section of the swimming pool coping at a time. In other embodiments, the molding system may extend along the entire swimming pool coping. In some embodiments, a molding system of the present invention is modular such that a plurality of molding platforms 10, backings 30, and/or molding blocks 40 are used to mold the swimming pool coping.

In some embodiments, molding systems of the present invention may also be used for molding the copings of swimming pools that do not include a track configured to receive a pool liner. These swimming pools may include, for example, certain concrete or fiberglass swimming pools which do not use or require a pool liner. According to some embodiments, molding systems of the present invention may be used with such swimming pools by providing a receiver track adapted to receive the molding systems. In some embodiments, the receiver track is configured to be secured to a top periphery of the swimming pool and engage with a molding system. The receiver track, in some embodiments, defines a slot, groove, channel, or the like configured to receive a portion of the molding system, for example, molding platform 10. In some embodiments, the receiver track is preferably positioned relative to the swimming pool such that the slot, groove, channel, or the like is open towards the swimming pool interior. In some embodiments, the receiver track includes one or more elements configured to be received within slot 26 of molding platform 10. In some embodiments, the receiver track is configured to engage with lip 14 and/or coping tabs 22 of molding platform 10 in a manner similar to track 6 shown in the embodiment of FIG. 2. Unlike track 6, however, the receiver track may not include any features particularly configured to secure a pool liner (e.g., pool liner 4). For example, the receiver track may not be shaped or configured to secure bead 4*a* of pool liner 4. In some embodiments, the receiver track may be configured to be positioned on wall portion 7 in the place of track 6 in FIG. 2. In some embodiments, the receiver track may include one or more flanges that can be secured to wall portion 7 when the receiver track is positioned on wall portion 7.

The receiver track and other components of the present invention can be fabricated from a variety of materials. For example, the receiver tracks and molding systems may be made from or include portions made from metal, plastics, polymers, wood, fiberglass, or composites. Other structurally sturdy materials, preferably with a degree of flexibility, may also be used to form components of the present invention. In some embodiments, the receiver tracks, molding systems, and/or one or more components thereof may be white or have a substantially light color so as to absorb less heat than components that are black or a substantially dark color. Components of the present invention may be prefabricated or, in other embodiments, may be assembled by the user. In some embodiments, the receiver tracks and molding systems of the present invention may be provided together in kits.

Figure 8A:
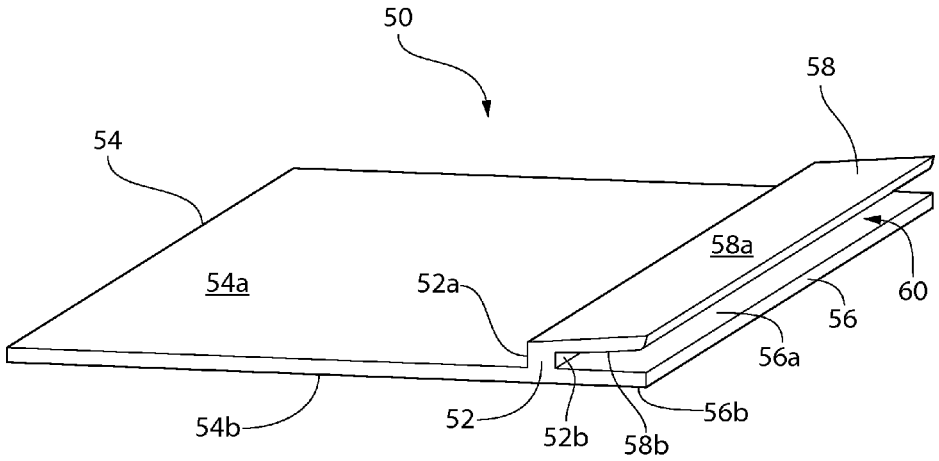
FIG. 8*a* is a perspective view of a receiver track in accordance with an embodiment of the present invention.
Figure 8B:
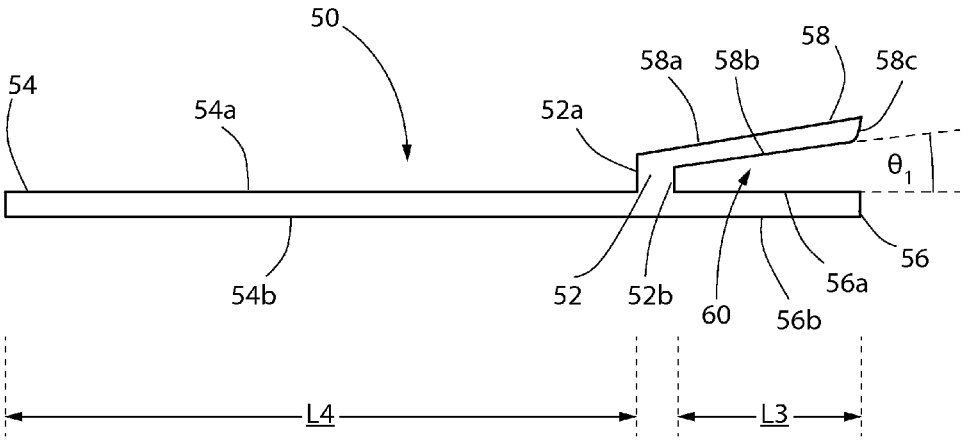
FIG. 8*b* is a side view of the receiver track of FIG. 8*a;*

FIGS. 8*a* and 8*b* show an example receiver track 50 in accordance with one embodiment of the present invention. Receiver track 50, in some embodiments, is particularly adapted to be used with the molding systems described herein. In some embodiments, receiver track 50 is configured to be used along straight sections of a swimming pool (e.g., straight section 3*c* of FIG. 1). In certain embodiments, receiver track 50 is configured to be positioned on a wall portion surrounding the swimming pool, for example, wall portion 7 of FIG. 2.

Receiver track 50, according to certain preferred embodiments, defines a space 60 that is configured to receive and engage with the molding systems described herein. Space 60 may be configured as, for example, a gap, slot, groove, channel or the like. In some embodiments, space 60 is configured to receive a portion of molding platform 10. For example, space 60 may be sized and configured to receive lips 14 and/or coping tabs 22 of molding platform 10. Receiver track 50 is preferably positionable relative to the swimming pool (e.g., along the swimming pool periphery) such that space 60 opens towards the swimming pool interior. In some embodiments, space 60 is disposed between two or more tabs, as will be described further herein.

In some embodiments, space 60 is defined in part by a support 52. In some embodiments, receiver track 50 includes a support 52 having a first side 52*a* and a second side 52*b* opposite first side 52*a*. First side 52*a* may be substantially parallel to second side 52*b* according to some embodiments. In further embodiments, support 52 extends along an entire dimension (e.g., width) of receiver track 50. Support 52, in some embodiments, is substantially rigid, and first side 52*a* and second side 52*b* may be substantially flat. In other embodiments, support 52 is flexible such that first side 52*a* and second side 52*b* can be curved convexly and/or concavely. In some embodiments, space 60 is defined in part by second side 52*b*.

In some embodiments, receiver track 50 includes a lower tab 56. In some embodiments, lower tab 56 extends from support 52 at or proximate the bottom of support 52. In some embodiments, lower tab 56 extends a length L3 from second side 52*b* of support 52. In some embodiments, length L3 is less than length L2 of coping tabs 22. In other embodiments, length L3 is greater than or equal to length L2 of coping tabs 22. Lower tab 56 may be integrally formed with support 52 in some embodiments. In other embodiments, lower tab 56 is formed separately from support 52 and secured thereto using any suitable means known in the art (e.g., adhesive, fasteners, joinery techniques, welding, etc.). In some embodiments, receiver track 50 includes only one lower tab 56. In some embodiments, lower tab 56 has a width that extends along an entire dimension (e.g., width) of receiver track 50 and/or support 52.

In some embodiments, lower tab 56 includes a top surface 56*a* and a bottom surface 56*b*. Top surface 56*a* and bottom surface 56*b* may be substantially parallel according to some embodiments. In some such embodiments, top surface 56*a* and bottom surface 56*b* are substantially perpendicular to second side 52*b* of support 52. Top surface 56*a* and/or bottom surface 56*b* may be substantially rectangular in shape or may be configured as another polygonal shape (e.g., square, trapezoid, etc.). According to these embodiments, lower tab 56 includes one or more straight edges. In further embodiments, lower tab 56 may include one or more curved edges.

In some embodiments, receiver track 50 includes an upper tab 58. In some embodiments, upper tab 58 extends from support 52 at or proximate a top of support 52. In some embodiments, upper tab 58 extends from second side 52*b* of support 52 and is vertically spaced above lower tab 56. Upper tab 58 may be integrally formed with support 52 in some embodiments. In other embodiments, upper tab 58 is formed separately from support 52 and secured thereto using any suitable means known in the art (e.g., adhesive, fasteners, joinery techniques, welding, etc.). In some embodiments, receiver track 50 includes only one upper tab 56. In some embodiments, upper tab 58 has a width that extends along an entire dimension (e.g., width) of receiver track 50 and/or support 52.

In some embodiments, upper tab 58 includes a top surface 58*a* and a bottom surface 58*b*. Top surface 58*a* and bottom surface 58*b* may be substantially parallel according to some embodiments. In some embodiments, top surface 58*a* and bottom surface 58*b* are substantially perpendicular to second side 52*b* of support 52. In other embodiments, as illustrated in FIGS. 8*a* and 8*b*, upper tab 58 extends obliquely from second side 52*b* of support 52. In some embodiments, bottom surface 58*b* of upper tab 58 is obliquely angled with respect to top surface 56*a* of lower tab 56. In some embodiments, bottom surface 58*b* of upper tab 58 and top surface 56*a* of lower tab 56 define an acute angle $\theta_1$ therebetween. In some embodiments, $\theta_1$ is from about 0° to about 10°, from about 1° to about 9°, from about 2° to about 8°, from about 3° to about 7°, from about 4° to about 6°, or about 5°. In some embodiments, top surface 58*a* and/or bottom surface 58*b* may be substantially rectangular in shape or may be configured as another polygonal shape (e.g., square, trapezoid, triangle, etc.). According to these embodiments, upper tab 58 includes one or more straight edges. In further embodiments, upper tab 58 may include one or more curved edges. In some embodiments, upper tab 58 includes a front edge 58*c* that may be convexly curved or radiused as shown in FIG. 8*b*.

In some embodiments, space 60 of receiver track 50 is disposed between upper tab 58 and lower tab 56. More particularly, in some embodiments, space 60 is at least partially defined by bottom surface 58*b* of upper tab 58 and top surface 56*a* of lower tab 56. As shown in the illustrated embodiment of FIGS. 8*a* and 8*b*, space 60 extends from second side 52*b* of support 52 a distance equal to length L3. In some embodiments, space 60 further extends along an entire dimension (e.g., width) of receiver track 50. In some embodiments, as discussed above, space 60 is configured to receive a portion of the molding systems described herein. In some embodiments, space 60 is configured to receive and secure to a portion of the molding systems in a friction fit. For example, in some embodiments space 60 is sized and configured to receive lips 14 of molding platform 10. According to some of these embodiments, when lips 14 are received in space 60, upper tab 58 may be received in slot 26 of molding platform 10 between lips 14 and coping tabs 22. In some embodiments, lower tab 56 and upper tab 58 cooperate to clip onto lips 14. In some embodiments, lips 14 and coping tabs 22 cooperate to clip onto upper tab 58. In certain variations, space 60 may be sized and configured to receive coping tabs 22. In these embodiments, when coping tabs 22 are received in space 60, lower tab 56 may be received in slot 26 of molding platform 10 between lips 14 and coping tabs 22. Molding platform 10 may further be combined with backing 30 and molding block 40 before or while engaged with space 60 of receiver track 50. Preferably, receiver track 50 is positioned during use such that mold supports 16 extend into or over the interior space of the swimming pool when molding platform 10 is engaged with receiver track 50.

In some embodiments, receiver track 50 further includes a track flange 54 that extends from first side 52*a* of support 52 a length L4. In some embodiments, length L4 is greater than length L3. In some embodiments, length L4 is greater than length L1 of mold supports 16. In other embodiments, length L4 is less than or equal to length L1. In some embodiments, track flange 54 is positioned at or proximate the bottom of support 52 and extends opposite of lower tab 56. In some embodiments, track flange 54 is integrally formed with support 52 and/or lower tab 56. In other embodiments, track flange 54 is formed separately from support 52 and/or lower tab 56 and secured thereto using any suitable means known in the art (e.g., adhesive, fasteners, joinery techniques, welding, etc.). In the embodiment shown, receiver track 50 includes only one track flange 54. In some embodiments, track flange 54 has a width that extends along an entire dimension (e.g., width) of receiver track 50 and/or support 52.

In some embodiments, track flange 54 includes a top surface 54*a* and a bottom surface 54*b*. Top surface 54*a* and bottom surface 54*b* may be substantially parallel according to some embodiments. In certain embodiments, top surface 56*a* of lower tab 56 is substantially coplanar with top surface 54*a* of track flange 54. In some embodiments, bottom surface 56*b* of lower tab 56 is substantially coplanar with bottom surface 54*b* of track flange 54. In some such embodiments, top surface 54*a* and bottom surface 54*b* are substantially perpendicular to first side 52*a* of support 52. Top surface 54*a* and/or bottom surface 54*b* may be substantially rectangular in shape or may be configured as another polygonal shape (e.g., square, trapezoid, triangle, etc.). According to these embodiments, track flange 54 includes one or more straight edges. In further embodiments, track flange 54 may include one or more curved edges.

In some embodiments, track flange 54 is configured to be secured to the periphery of a swimming pool once receiver track 50 is arranged in its desired position. For example, track flange 54 may be secured to wall portion 7 in FIG. 2 when receiver track 50 is used in place of track 6. In some embodiments, track flange 54 may be secured into position by any suitable means known in the art, for example, using screws, nail, bolts, glue, cement, tape, etc. Preferably receiver track 50 is positioned such that space 60 opens towards the swimming pool interior. After receiver track 50 is secured into position, receiver track 50 may be engaged with the molding system as described above.

After the molding system is engaged with receiver track 50, the molding system may be used to mold the coping of the swimming pool in a manner similar to the procedures described above with respect to embodiments where the molding system is engaged with track 6. In certain embodiments, concrete or other material used to form the swimming pool coping can be poured over receiver track 50, which may be left in place along the periphery of the swimming pool. According to some of these embodiments, receiver track 50 forms a part of the finished swimming pool coping. In some embodiments, molding platform 10, backing 30, and molding block 40 are removed from the swimming pool coping before the concrete or other material completely hardens, for example, to allow the surface of the concrete or other material to be smoothed or textured.

Figure 9A:
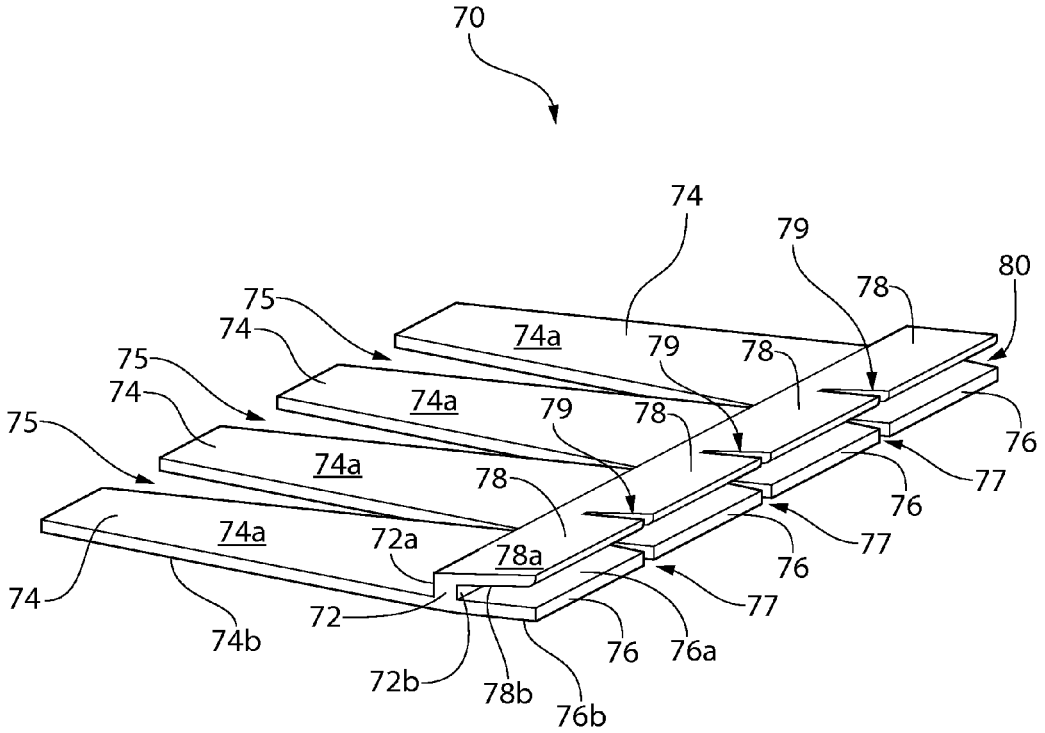
FIGS. 9*a* and 9*b* are perspective views of a receiver track in accordance with a further embodiment of the present invention.
Figure 9B:
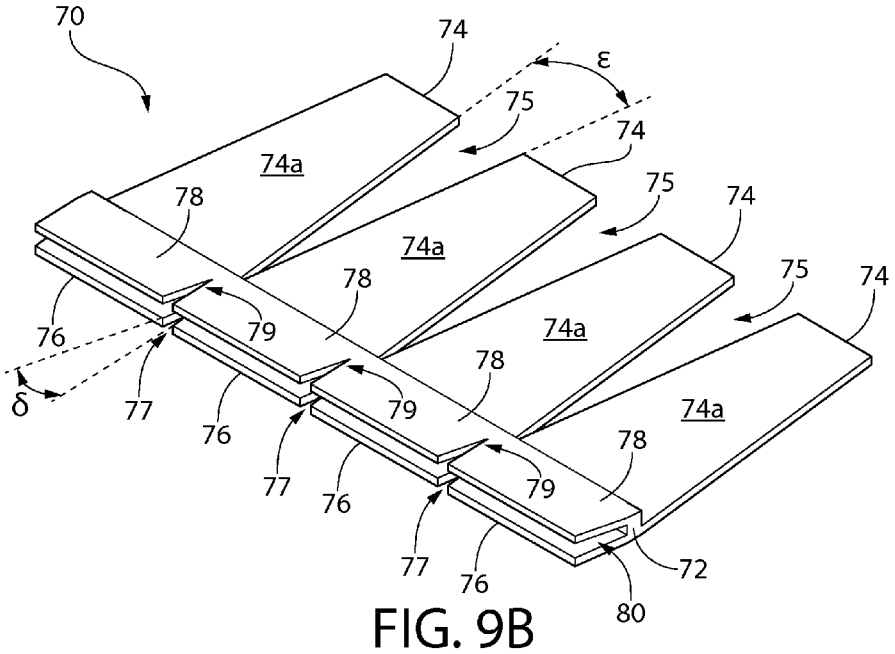
Figure 9C:
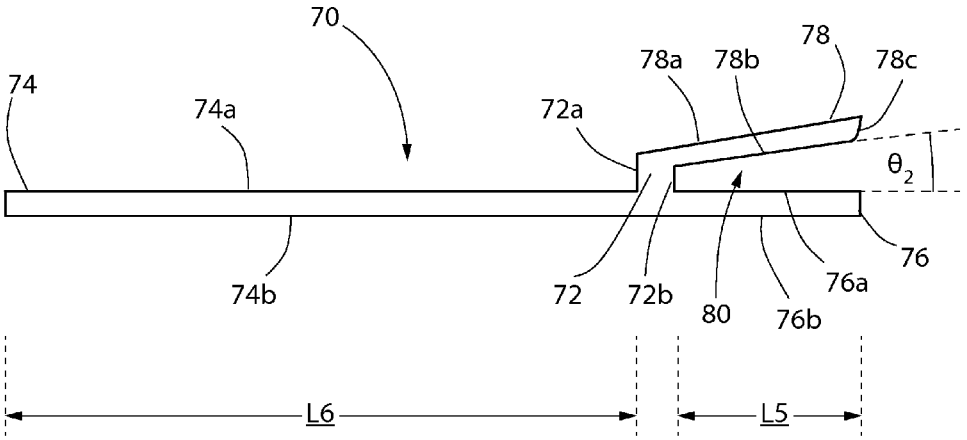
FIG. 9*c* is a side view of the receiver track of FIGS. 9*a* and 9*b*.

FIGS. 9*a*-9*c* show a second example receiver track 70 in accordance with further embodiments of the present invention for use with the molding systems described herein. In some embodiments, receiver track 70 is configured to be used along straight and/or curved sections of a swimming pool. In certain embodiments, receiver track 70 is configured to be positioned on a wall portion of the swimming pool, for example, wall portion 7 of FIG. 2.

Receiver track 70, according to certain preferred embodiments, defines a space 80 that is configured to receive and engage with the molding systems described herein. Space 80 may be configured as, for example, a gap, slot, groove, channel or the like. In some embodiments, space 80 is configured to clip onto a portion of molding platform 10. For example, space 80 may be sized and configured to clip onto lips 14 and/or coping tabs 22 of molding platform 10. Receiver track 70 is preferably positionable relative to the swimming pool (e.g., along the swimming pool periphery) such that space 80 opens towards the swimming pool interior. In some embodiments, space 80 is disposed between two or more tabs, as will be described further herein.

In some embodiments, space 80 is defined in part by a support 72. In some embodiments, receiver track 80 includes a support 72 having a first side 72*a* and a second side 72*b* opposite first side 72*a*. First side 72*a* may be substantially parallel to second side 72*b* according to some embodiments. In further embodiments, support 72 extends along an entire dimension (e.g., width) of receiver track 70. Support 72, in some embodiments, is substantially flexible such that first side 72*a* and second side 72*b* can be curved convexly and/or concavely when receiver track 70 is in a flexed state. In some embodiments, first side 72*a* and second side 72*b* are substantially planar when receiver track 70 is an unflexed or relaxed state. In some embodiments, space 80 is defined in part by second side 72*b*.

In some embodiments, receiver track 70 includes a plurality of lower tabs 76. For ease of illustration, the embodiment of FIGS. 9*a* and 9*b* shows four lower tabs 76. It should be appreciated, however, that receiver track 70 may include any suitable number of lower tabs 76 according to other embodiments. For example, in other embodiments, receiver track 70 may include more than four lower tabs 76. In some embodiments, receiver track 70 includes fewer than four lower tabs 76. Preferably, receiver track 70 includes at least two lower tabs 76.

In some embodiments, lower tabs 76 extend from support 72 at or proximate the bottom of support 72. In some embodiments, lower tabs 76 are arranged in an evenly spaced row along second side 72*b*. In some embodiments, lower tabs 76 extend a length L5 from second side 72*b* of support 72. In some embodiments, length L5 is less than length L2 of coping tabs 22. In other embodiments, length L5 is greater than or equal to length L2 of coping tabs 22. In some embodiments, length L5 is equal to length L3 of receiver track 50. Lower tabs 76 may be integrally formed with support 72 in some embodiments. In other embodiments, lower tabs 76 are formed separately from support 72 and secured thereto using any suitable means known in the art (e.g., adhesive, fasteners, joinery techniques, welding, etc.). In some embodiments, the plurality of lower tabs 76 are positioned along an entire dimension (e.g., width) of receiver track 70 and/or support 72.

In some embodiments, each lower tab 76 includes a top surface 76*a* and a bottom surface 76*b*. In certain embodiments, top surfaces 76*a* of lower tabs 76 are each coplanar. Likewise, in some embodiments, bottom surfaces 76*b* of lower tabs 76 are each coplanar. Top surface 76*a* and bottom surface 76*b* may be substantially parallel according to some embodiments. In some such embodiments, top surface 76*a* and bottom surface 76*b* are substantially perpendicular to second side 72*b* of support 72. As shown in FIGS. 9*a* and 9*b*, top surface 76*a* and/or bottom surface 76*b* may be substantially trapezoidal in shape. In some embodiments, top surface 76*a* and/or bottom surface 76*b* of each lower tab 76 is shaped as an isosceles trapezoid having a height equal to length L5 and its longer base positioned at second side 72*b* of support 72. In other embodiments, top surface 76*a* and/or bottom surface 76*b* may be configured as another polygonal shape (e.g., square, rectangle, triangle, etc.). According to these embodiments, each lower tab 76 includes one or more straight edges. In further embodiments, each lower tab 76 may include one or more curved edges.

In some embodiments, adjacent lower tabs 76 are separated by a gap 77. In some embodiments, each gap 77 has a length equal to the length of each lower tab 76 (e.g., length L5). In other embodiments, each gap 77 has a length shorter than the length of each lower tab 76 (e.g., shorter than length L5). Gaps 77 in some embodiments are configured to provide a degree of clearance between adjacent lower tabs 76 to allow for receiver track 70 to be curved, for example, when receiver track 70 is in a flexed state. This configuration may be advantageous according to certain embodiments, for example, when receiver track 70 is positioned along a curved section of the swimming pool (e.g., curved sections 3*a* and 3*b* of FIG. 1).

As shown in FIG. 9*b*, gaps 77 may be defined by angle δ formed between adjacent lower tabs 76 according to some embodiments. In some embodiments, angle δ is equal to the angle between the neighboring side edges of adjacent lower tabs 76. In some embodiments, angle δ is an acute angle from about 0° to about 45°, about 0° to about 40°, about 0° to about 35°, about 0° to about 30°, about 0° to about 28°, about 0° to about 25°, about 0° to about 20°, about 0° to about 15°, about 0° to about 10°, or about 0° to about 5°. In some embodiments, when receiver track 70 is in an unflexed or relaxed state, angle δ is from about 5° and about 25°, about 10° and about 20°, about 12° and about 18°, or about 14° and about 16°. In one embodiment, angle δ is about 14° when receiver track 70 is in an unflexed or relaxed state. In some embodiments, angle δ is substantially equal to angle α and/or angle β of molding platform 10 when molding platform 10 and receiver track 70 are both in an unflexed or relaxed state.

Angle δ may be increased or decreased relative to the angle in the unflexed or relaxed state depending on the desired curvature of receiver track 70. For example, when receiver track 70 is used with a concavely curved section of the swimming pool (e.g., curved section 3*b* of FIG. 1), receiver track 70 may be flexed such that the ends of lower tabs 76 converge towards each other and angle δ is decreased. When receiver track is used with a convexly curved section of the swimming pool (e.g., curved section 3*a* of FIG. 1), receiver track 70 is flexed such that the ends of lower tabs 76 diverge away from each other and angle δ is increased.

In some embodiments, receiver track 70 includes a plurality of upper tabs 78. For ease of illustration, the embodiment of FIGS. 9*a* and 9*b* shows four upper tabs 78. It should be appreciated, however, that receiver track 70 may include any suitable number of upper tabs 78 according to other embodiments. For example, in other embodiments, receiver track 70 may include more than four upper tabs 78. In some embodiments, receiver track 70 includes fewer than four upper tabs 78. In some embodiments, receiver track 70 includes at least two upper tabs 78. In certain preferred embodiments, receiver track 70 includes the same number of upper tabs 78 and lower tabs 76.

In some embodiments, each upper tab 78 extend from support 72 at or proximate a top of support 72. In some embodiments, upper tabs 78 are arranged in an evenly spaced row along second side 72*b*. In some embodiments, upper tabs 78 extend from second side 72*b* of support 72 and are vertically aligned with and spaced above lower tabs 76. Upper tabs 78 may be integrally formed with support 72 in some embodiments. In other embodiments, upper tabs 78 are formed separately from support 72 and secured thereto using any suitable means known in the art (e.g., adhesive, fasteners, joinery techniques, welding, etc.). In some embodiments, the plurality of upper tabs 78 are positioned along an entire dimension (e.g., width) of receiver track 70 and/or support 72.

In some embodiments, each upper tab 78 includes a top surface 78*a* and a bottom surface 78*b*. In certain embodiments, top surfaces 78*a* of upper tabs 78 are each coplanar. Likewise, in some embodiments, bottom surfaces 78*b* of upper tabs 78 are each coplanar. Top surface 78*a* and bottom surface 78*b* may be substantially parallel according to some embodiments. In some embodiments, top surface 78*a* and bottom surface 78*b* are substantially perpendicular to second side 72*b* of support 72. In other embodiments, as illustrated in FIGS. 9*a*-9*c*, upper tabs 78 extend obliquely from second side 72*b* of support 72. In some embodiments, bottom surface 78*b* of upper tabs 78 is obliquely angled with respect to top surface 76*a* of lower tabs 76. In some embodiments, bottom surface 78*b* of upper tabs 78 and top surface 76*a* of lower tabs 76 define an acute angle $\theta_2$ therebetween. In some embodiments, $\theta_2$ is from about 0° to about 10°, from about 1° to about 9°, from about 2° to about 8°, from about 3° to about 7°, from about 4° to about 6°, or about 5°.

As shown in FIGS. 9*a* and 9*b*, top surface 78*a* and/or bottom surface 78*b* may be substantially trapezoidal in shape. In some embodiments, top surface 78*a* and/or bottom surface 78*b* of each upper tab 78 is shaped as an isosceles trapezoid having its longer base positioned at second side 72*b* of support 72. In other embodiments, top surface 76*a* and/or bottom surface 76*b* may be configured as another polygonal shape (e.g., square, rectangle, triangle, etc.). According to these embodiments, each upper tab 78 includes one or more straight edges. In further embodiments, each upper tab 78 may include one or more curved edges. In some embodiments, upper tabs 78 include a front edge 78*c* that may be convexly curved or radiused as shown in FIG. 9*c*.

In some embodiments, adjacent upper tabs 78 are separated by a gap 79. In certain preferred embodiments, gaps 79 are substantially aligned with and vertically spaced with gaps 77. Gaps 79 in some embodiments are configured to provide a degree of clearance between adjacent upper tabs 79 to allow for receiver track 70 to be curved, for example, when receiver track 70 is in a flexed state. As described, this configuration may be advantageous according to certain embodiments, for example, when receiver track 70 is positioned along a curved section of the swimming pool (e.g., curved sections 3*a* and 3*b* of FIG. 1).

In some embodiments, gaps 79 are defined by an angle that is equal to angle δ of gaps 77 as described above. In some embodiments, the angle of gaps 79 is configured to increase or decrease to the same extent as angle δ when receiver track 70 is being flexed. Thus, in some embodiments, the angle of gaps 79 is an acute angle from about 0° to about 45°, about 0° to about 40°, about 0° to about 35°, about 0° to about 30°, about 0° to about 28°, about 0° to about 25°, about 0° to about 20°, about 0° to about 15°, about 0° to about 10°, or about 0° to about 5°. In some embodiments, when receiver track 70 is in an unflexed or relaxed state, the angle of gaps 79 is from about 5° and about 25°, about 10° and about 20°, about 12° and about 18°, or about 14° and about 16°. In one embodiment, the angle of gaps 79 is about 14° when receiver track 70 is in an unflexed or relaxed state. In some embodiments, the angle of gaps 79 is substantially equal to angle α and/or angle β of molding platform 10 when molding platform 10 and receiver track 70 are both in an unflexed or relaxed state.

In some embodiments, space 80 of receiver track 70 is disposed between upper tabs 78 and lower tabs 76. More particularly, in some embodiments, space 80 is at least partially defined by bottom surface 78*b* of upper tabs 78 and top surface 76*a* of lower tabs 76. As shown in the illustrated embodiment of FIG. 9*c*, space 80 extends from second side 72*b* of support 72 a distance equal to length L5. In some embodiments, space 80 further extends along an entire dimension (e.g., width) of receiver track 70. In some embodiments, as discussed above, space 80 is configured to receive a portion of the molding systems described herein. In some embodiments, space 80 is configured to receive and secure to a portion of the molding systems in a friction fit. For example, in some embodiments space 80 is sized and configured to receive lips 14 of molding platform 10. According to some of these embodiments, when lips 14 are received in space 80, upper tabs 78 may be received in slot 26 of molding platform 10 between lips 14 and coping tabs 22. In some embodiments, lower tabs 76 and upper tabs 78 cooperate to clip onto lips 14. In some embodiments, lips 14 and coping tabs 22 cooperate to clip onto upper tabs 78. In certain variations, space 80 may be sized and configured to receive coping tabs 22. In these embodiments, when coping tabs 22 are received in space 80, lower tabs 76 may be received in slot 26 of molding platform 10 between lips 14 and coping tabs 22. Molding platform 10 may further be combined with backing 30 and molding block 40 before or while engaged with space 80 of receiver track 70. Preferably, receiver track 70 is positioned during use such that mold supports 16 extend into or over the interior space of the swimming pool when molding platform 10 is engaged with receiver track 70.

In some embodiments, receiver track 70 includes a plurality of track flanges 74. For ease of illustration FIGS. 9*a* and 9*b* show four track flanges 74, however, it should be appreciated that receiver track 70 may include any suitable number of track flanges 74. For example, in other embodiments, receiver track 70 may include more than four track flanges 74. In some embodiments, receiver track 70 includes fewer than four track flanges 74. In some embodiments, receiver track 70 includes at least two track flanges 74. Preferably, the number of track flanges 74 is equal to the number of lower tabs 76 and/or upper tabs 78.

In some embodiments, track flanges 74 are arranged in an evenly spaced row along first side 72*a*. In some embodiments, track flanges 74 extend from first side 72*a* of support 72 a distance L6. In some embodiments, length L6 is greater than length L5. In some embodiments, length L6 is greater than length L1 of mold supports 16. In other embodiments, length L6 is less than or equal to length L1. In some embodiments, track flanges 74 are positioned at or proximate the bottom of support 72 and extend opposite of lower tabs 76. In some embodiments, track flanges 74 are integrally formed with support 72. In other embodiments, track flanges 74 are formed separately from support 72 and secured thereto using any suitable means known in the art (e.g., adhesive, fasteners, joinery techniques, welding, etc.).

In some embodiments, each track flange 74 includes a top surface 74*a* and a bottom surface 74*b*. Top surface 74*a* and bottom surface 74*b* may be substantially parallel according to some embodiments. In some such embodiments, top surface 74*a* and bottom surface 74*b* are substantially perpendicular to first side 72*a* of support 72. In some embodiments, each top surface 74*a* of track flanges 74 is coplanar. In some embodiments, each bottom surface 74*b* of track flanges 74 is coplanar. In some embodiments, top surface 74*a* of track flanges 74 is coplanar with top surface 76*a* of lower tabs 76. In some embodiments, bottom surface 74*b* of track flanges 74 is coplanar with bottom surface 76*b* of lower tabs 76.

As shown in FIGS. 9*a* and 9*b*, top surface 74*a* and/or bottom surface 74*b* may be substantially trapezoidal in shape. In some embodiments, top surface 74*a* and/or bottom surface 74*b* of each track flange 74 is shaped as an isosceles trapezoid having a height equal to length L6 and its longer base positioned at first side 72*a* of support 72. In other embodiments, top surface 74*a* and/or bottom surface 74*b* may be configured as another polygonal shape (e.g., square, rectangle, triangle, etc.). According to these embodiments, each track flanges 74 includes one or more straight edges. In further embodiments, each track flange 74 may include one or more curved edges.

In some embodiments, adjacent track flanges 74 are separated by a gap 75. In some embodiments, each gap 75 has a length equal to the length of each track flange 74 (e.g., length L6). In other embodiments, gap 75 has a length shorter than the length of each track flange 74 (e.g., shorter than length L6). Gaps 75 in some embodiments are configured to provide a degree of clearance between adjacent track flanges 74 to allow for receiver track 70 to be curved. As described, this configuration may be advantageous according to certain embodiments, for example, when receiver track 70 is positioned along a curved section of the swimming pool (e.g., curved sections 3*a* and 3*b* of FIG. 1). As shown in FIGS. 9*a* and 9*b*, gaps 75 may be substantially aligned with gaps 77 in opposing pairs.

Gap 75 may be defined by angle $\epsilon$ formed between adjacent track flanges 74 according to some embodiments. In some embodiments, angle $\epsilon$ is equal to the angle between the neighboring side edges of adjacent track flanges 74. In some embodiments, angle $\epsilon$ is an acute angle from about 0° to about 45°, about 0° to about 40°, about 0° to about 35°, about 0° to about 30°, about 0° to about 28°, about 0° to about 25°, about 0° to about 20°, about 0° to about 15°, about 0° to about 10°, or about 0° to about 5°. In some embodiments, when receiver track 70 is in an unflexed or relaxed state, angle $\delta$ is from about 5° and about 25°, about 10° and about 20°, about 12° and about 18°, or about 14° and about 16°. In one embodiment, angle $\epsilon$ is about 14° when receiver track 70 is in an unflexed or relaxed state. In some embodiments, angle $\epsilon$ is substantially equal to angle $\delta$ when receiver track 70 is in an unflexed or relaxed state. In some embodiments, angle $\epsilon$ is substantially equal to angle $\alpha$ and/or angle $\beta$ of molding platform 10 when molding platform 10 and receiver track 70 are both in an unflexed or relaxed state.

Similar to angle $\delta$, angle $\epsilon$ may be increased or decreased relative to the angle in the unflexed or relaxed state depending on the desired curvature of receiver track 70 according to some embodiments. For example, when receiver track 70 is used with a convexly curved section of the swimming pool (e.g., curved section 3*a* of FIG. 1), receiver track 70 may be flexed such that the ends of track flanges 74 converge towards each other and angle $\epsilon$ is decreased. When receiver track is used with a concavely curved section of the swimming pool (e.g., curved section 3*b* of FIG. 1), receiver track 70 may be flexed such that the ends of track flanges 74 diverge away from each other and angle $\epsilon$ is increased. In some embodiments, when receiver track 70 is being flexed, angle $\epsilon$ increases as opposing angle $\delta$ decreases and vice versa.

In some embodiments, track flanges 74 are configured to be secured to the periphery of a swimming pool once receiver track 70 is arranged in its desired position. For example, track flanges 74 may be secured to wall portion 7 in FIG. 2 when receiver track 70 is used in place of track 6. In some embodiments, track flanges 74 may be secured into position by any suitable means known in the art, for example, using screws, nail, bolts, glue, cement, tape, etc. Preferably receiver track 70 is positioned such that space 80 opens towards the swimming pool interior. After receiver track 70 is secured into position, receiver track 70 may be engaged with the molding system as described above.

After the molding system is engaged with receiver track 70, the molding system may be used to mold the coping of the swimming pool in a manner similar to the procedures described above with respect to embodiments where the molding system is engaged with track 6. In certain embodiments, concrete or other material used to form the swimming pool coping can be poured over receiver track 70, which may be left in place along the periphery of the swimming pool. According to some of these embodiments, receiver track 70 forms a part of the finished swimming pool coping. In some embodiments, molding platform 10, backing 30, and molding block 40 are removed from the swimming pool coping before the concrete or other material completely hardens, for example, to allow the surface of the concrete or other material to be smoothed or textured.

In some embodiments, receiver tracks and molding systems of the present invention can be used to mold one section of the swimming pool coping at a time. In other embodiments, a receiver track and molding system may extend along the entire swimming pool coping. In some embodiments, a receiver track of the present invention is modular such that a plurality of receiver tracks are used with the molding system to mold the swimming pool coping. In some embodiments, for example, both receiver track 50 and receiver track 70 can be utilized together. In one such embodiment, receiver track 50 is utilized along straight sections of the swimming pool (e.g., straight section 3*c* of FIG. 1) and receiver track 70 is utilized along curved sections of the swimming pool (e.g., curved sections 3*a* and 3*b* of FIG. 1).

While the embodiments described herein are illustrative of molding systems particularly useful for molding swimming pool copings, the molding systems described herein are not necessarily limited to this use. Some embodiments of the present invention may also be used for molding copings in connection with other pools (e.g., reflecting pools), ponds, baths, tubs, fountains, or the like. Indeed, molding systems according to certain embodiments of the present invention may be useful for molding other structures, for example, walls, countertops, overhangs, eaves, curbs, or the like. Other applications involving the molding of concrete or other materials may also benefit from embodiments of the present invention for at least the reasons set forth herein.

It will be appreciated by those skilled in the art that changes could be made to the exemplary embodiments shown and described above without departing from the broad inventive concepts thereof. It is understood, therefore, that this invention is not limited to the exemplary embodiments shown and described, but it is intended to cover modifications within the spirit and scope of the present invention as defined by the claims. For example, specific features of the exemplary embodiments may or may not be part of the claimed invention and various features of the disclosed embodiments may be combined. Unless specifically set forth herein, the terms "a", "an" and "the" are not limited to one element but instead should be read as meaning "at least one".

It is to be understood that at least some of the figures and descriptions of the invention have been simplified to focus on elements that are relevant for a clear understanding of the invention, while eliminating, for purposes of clarity, other elements that those of ordinary skill in the art will appreciate may also comprise a portion of the invention. However, because such elements are well known in the art, and because they do not necessarily facilitate a better understanding of the invention, a description of such elements is not provided herein.

Further, to the extent that the method does not rely on the particular order of steps set forth herein, the particular order of the steps should not be construed as limitation on the claims. The claims directed to the method of the present invention should not be limited to the performance of their steps in the order written, and one skilled in the art can readily appreciate that the steps may be varied and still remain within the spirit and scope of the present invention.

What is claimed is:

1. A molding system for a swimming pool coping having a track for receiving a pool liner, the molding system comprising:

a molding platform comprising:

a flexible panel having a first side and a second side opposite the first side;

at least one lip extending from the first side of the flexible panel configured to be received in the track of the swimming pool coping when the molding platform is engaged with the swimming pool coping;

a plurality of mold supports extending from the second side of the flexible panel and arranged in a row proximate a top of the flexible panel, each mold support comprising:

a top surface for supporting a mold block; and a flange positioned proximate an end of the mold support extending substantially perpendicularly from the top surface.

2. The molding system of claim 1 further comprising:

a back panel having a front surface and a back surface, the back panel configured to engage with the molding platform and comprising at least one clip defining a slot for receiving the flange of at least one of the plurality of mold supports when the back panel is engaged with the molding platform.

3. The molding system of claim 2, wherein the at least one clip is positioned on the back surface of the back panel.

4. The molding system of claim 2, wherein the back panel comprises at least one clip for each mold support in the plurality of mold supports.

5. The molding system of claim 2, wherein the back panel comprises a ledge extending from the front surface of the back panel proximate a top of the back panel.

6. The molding system of claim 1 further comprising:

a molding block positionable on the top surface of at least one of the plurality of mold supports, the molding block having a mold surface configured to mold a predetermined contour into a material.

7. The molding system of claim 1, wherein the molding platform further comprises a plurality of coping tabs extending from the first side of the flexible panel and arranged in a row proximate a top of the flexible panel, the plurality of coping tabs and the at least one lip defining a slot for receiving a section of the swimming pool coping when the molding platform is engaged with the swimming pool coping.

8. The molding system of claim 7, wherein the slot defined by the plurality of coping tabs and the at least one lip tapers from the flexible panel toward an end of the at least one lip.

9. The molding system of claim 7, wherein the plurality of coping tabs extends obliquely from the first side of the flexible panel.

10. The molding system of claim 7, wherein each of the plurality of coping tabs comprises a pair of side edges, a top surface extending between the pair of side edges, and a front end.

11. The molding system of claim 10, wherein the top surface of each coping tab is contiguous with the top surface of at least one of the plurality of mold supports.

12. The molding system of claim 10, wherein each coping tab tapers in width from the first side of the flexible panel towards the front end of the coping tab.

13. The molding system of claim 10, wherein the top surface of each coping tab is substantially trapezoidal in shape.

14. The molding system of claim 7, wherein the molding platform comprises a gap between each pair of adjacent coping tabs.

15. The molding system of claim 14, wherein the gap between each pair of adjacent coping tabs comprises an acute angle defined by side edges of the pair of adjacent coping tabs.

16. The molding system of claim 1, wherein each mold support tapers in width from the second side of the flexible panel towards the end of the mold support.

17. The molding system of claim 1, wherein the top surface of each mold support is substantially trapezoidal in shape.

18. The molding system of claim 1, wherein the molding platform comprises a gap between each pair of adjacent mold supports.

19. The molding system of claim 18, wherein the gap between each pair of adjacent mold supports comprises an acute angle defined by side edges of the pair of adjacent mold supports.

20. A molding system for a swimming pool coping having a track for receiving a pool liner, the molding system comprising:

a molding platform comprising:

a flexible panel having a first side and a second side opposite the first side;

at least one lip extending from the first side of the flexible panel configured to be received in the track of the swimming pool coping when the molding platform is engaged with the swimming pool coping;

a plurality of mold supports extending from the second side of the flexible panel and arranged in a row proximate a top of the flexible panel, each mold support comprising:

a top surface for supporting a mold block;

a flange positioned at a first end of the mold support extending from the top surface; and a plurality of coping tabs extending from the first side of the flexible panel and arranged in a row proximate a top of the flexible panel;

a back panel having a front surface and a back surface, the back panel configured to engage with the molding platform and comprising at least one clip defining a slot for receiving the flange of at least one of the plurality of mold supports when the back panel is engaged with the molding platform; and a molding block positionable on the top surface of at least one of the plurality of mold supports, the molding block having a contoured mold surface.

21. A kit for molding a swimming pool coping comprising:

a molding system comprising:

a molding platform comprising:

a flexible panel having a first side and a second side opposite the first side;

at least one lip extending from the first side of the flexible panel;

a plurality of mold supports extending from the second side of the flexible panel and arranged in a row proximate a top of the flexible panel, each mold support comprising:

a top surface for supporting a mold block; and a flange positioned proximate an end of the mold support extending substantially perpendicularly from the top surface; and a receiver track configured to engage with the molding system comprising:

a support having a first side and a second side opposite the first side;

a lower tab extending from the second side of the support, the lower tab comprising a top surface and a bottom surface;

an upper tab extending from the second side of the support and positioned above the lower tab, the upper tab comprising a top surface and a bottom surface; and a space defined by the top surface of the lower tab and the bottom surface of the upper tab, the space being sized and configured for receiving the at least one lip of the molding system when the receiver track is engaged with the molding system.

22. The kit of claim 21, further comprising a back panel having a front surface and a back surface, the back panel configured to engage with the molding platform and comprising at least one clip defining a slot for receiving the flange of at least one of the plurality of mold supports when the back panel is engaged with the molding platform.

23. The kit of claim 21, further comprising a molding block positionable on the top surface of at least one of the plurality of mold supports, the molding block having a contoured mold surface.

24. The kit of claim 21, wherein the molding platform further comprises a plurality of coping tabs extending from the first side of the flexible panel and arranged in a row proximate a top of the flexible panel, the plurality of coping tabs and the at least one lip defining a slot for receiving the upper tab of the receiver track when the receiver track is engaged with the molding system.

* * * * *